US012557898B2

(12) United States Patent
Hayward et al.

(10) Patent No.: US 12,557,898 B2
(45) Date of Patent: Feb. 24, 2026

(54) BACKPACK FOR SPORTING EQUIPMENT

(71) Applicant: THE VILLAGE HIDDEN IN THE HEAVENS LLC, Augusta, MI (US)

(72) Inventors: Cole Hayward, Augusta, MI (US); Michael Rex Gruizinga, Kalamazoo, MI (US); Joseph Richard Regimbald, Chicago, IL (US)

(73) Assignee: THE VILLAGE HIDDEN IN THE HEAVENS LLC, Augusta, MI (US)

( * ) Notice: Subject to any disclaimer, the term of this patent is extended or adjusted under 35 U.S.C. 154(b) by 223 days.

(21) Appl. No.: 18/455,864

(22) Filed: Aug. 25, 2023

(65) Prior Publication Data

US 2024/0074566 A1 Mar. 7, 2024

Related U.S. Application Data

(60) Provisional application No. 63/404,268, filed on Sep. 7, 2022.

(51) Int. Cl.
*A45F 3/08* (2006.01)
*A45F 3/00* (2006.01)

(52) U.S. Cl.
CPC ..... *A45F 3/08* (2013.01); *A45F 2003/003* (2013.01)

(58) Field of Classification Search
CPC .. A45F 3/04; A45F 3/042; A45F 3/045; A45F 3/047; A45F 3/06; A45F 3/08; A45F 2003/003
USPC ..... 224/197, 200, 917, 581–584, 185, 645, 224/682–683, 629, 633, 261
See application file for complete search history.

(56) References Cited

U.S. PATENT DOCUMENTS 1,570,500 A * 1/1926 Kennedy ..... A45F 5/1566 206/315.6
2,422,315 A * 6/1947 Robinson ..... A45F 5/1566 206/315.7
2,502,627 A * 4/1950 Martin ..... A63B 55/408 206/315.6
3,903,944 A * 9/1975 Montgomery ..... A45C 3/00 224/438
4,655,346 A * 4/1987 Reinholz ..... A63B 55/40 206/315.6
5,415,284 A * 5/1995 King ..... A63B 55/60 280/DIG. 6

(Continued)

FOREIGN PATENT DOCUMENTS

ES 2924449 A1 * 10/2022 ..... A63B 55/57
FR 2968176 A3 * 6/2012 ..... A45F 3/04

*Primary Examiner* — Scott T Mcnurlen
(74) *Attorney, Agent, or Firm* — Endurance Law Group PLC; James R. Yee

(57) ABSTRACT

A backpack includes a base, a harness, a hinge mechanism, a first cartridge and a second cartridge. The harness is coupled to the base and is configured to be removably worn by a person. The hinge mechanism is coupled to the base. The first cartridge is configured to removably store at least one piece of sporting equipment, such as a golf club, and is rotatably coupled to the base by the hinge mechanism. The second cartridge is configured to removably store at least one other piece of sporting equipment, such as a golf club, and is rotatably coupled to the base by the hinge mechanism. The hinge mechanism is configured to allow each of the first and second cartridges to be rotated between an upright position and a cross position.

12 Claims, 28 Drawing Sheets

(56) References Cited

U.S. PATENT DOCUMENTS

| | | | | |
|---|---|---|---|---|
| 6,149,041 | A * | 11/2000 | Perino | A63B 55/00 224/582 |
| 6,422,444 | B1 * | 7/2002 | Richardson | A63B 55/50 206/315.3 |
| 2009/0145787 | A1 * | 6/2009 | Grander | A63B 55/50 206/315.6 |
| 2010/0176012 | A1 * | 7/2010 | Carter | A45F 5/1566 206/315.3 |

* cited by examiner

BACKPACK FOR SPORTING EQUIPMENT

CROSS REFERENCE TO RELATED APPLICATIONS

This application claims priority to Provisional Patent Application 63/404,268, filed on Sep. 7, 2022, the entire disclosure of which is hereby incorporated by reference and relied upon.

FIELD OF THE INVENTION

The invention relates generally to a backpack for carrying golf clubs, and more particularly to, a golf club backpack that may be worn by a person that may be worn in transit and on the golf course.

BACKGROUND OF THE INVENTION

Traditional bags for carrying sports equipment are bulky and heavy. For instance, golf bags may be utilized for carrying golf clubs and golf accessories. A golf bag may also be used to store golf clubs and accessories in between golf sessions, for example, either in the trunk or in a separate location, for example, a garage. A golf bag may also be utilized to protect the sporting equipment during transport, for example, as checked in baggage on a plane. A golf bag may also be carried or transported around the golf course, for example, on a golf cart or carried during play.

However, some golfers desire to travel to, and from, the golf course, using mode of transportation other than an automobile or truck, such as a motorcycle or bicycle. Traditional golf bags are generally too heavy and bulky to be transported on a motorcycle. Furthermore, in a traditional golf bags, the golf clubs are generally carried upright or vertical in a single tube-shaped container. Such an arrangement is generally too long to be carried or transported on a motorcycle or bicycle.

The present invention is aimed at one or more of the problems identified above.

BRIEF SUMMARY OF THE INVENTION

In a first aspect of the present invention, a backpack is provided. The backpack includes a base, a harness, a hinge mechanism, a first cartridge and a second cartridge. The harness is coupled to the base and is configured to be removably worn by a person. The hinge mechanism is coupled to the base. The first cartridge is configured to removably store at least one piece of sporting equipment, such as a golf club, and is rotatably coupled to the base by the hinge mechanism. The second cartridge is configured to removably store at least one other piece of sporting equipment, such as a golf club, and is rotatably coupled to the base by the hinge mechanism. The hinge mechanism is configured to allow each of the first and second cartridges to be rotated between an upright position and a cross position.

In a second aspect of the present invention, a backpack, is provided. The backpack includes a base, a harness, a hinge mechanism and first and second cartridges. The harness includes a pair of shoulder straps coupled to the base and configured to be removably worn by a person. The hinge mechanism is coupled to the base. The first cartridge is configured to removably store at least one piece of sporting equipment, such as a golf club, and is rotatably coupled to the base by the hinge mechanism. The second cartridge is configured to removably store at least one other piece of sporting equipment, such as a golf club. The hinge mechanism is configured to allow each of the first and second cartridge to be rotated between an upright position and a cross position. Each of the first and second cartridges includes a frame and an outer covering. The frame of each of the first and second cartridges includes at least one framing member, an upper member and a bottom member. The framing member is coupled between the upper and bottom members. The upper member defines a plurality of predefined inner golf club lanes configured to receive a respective golf club.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
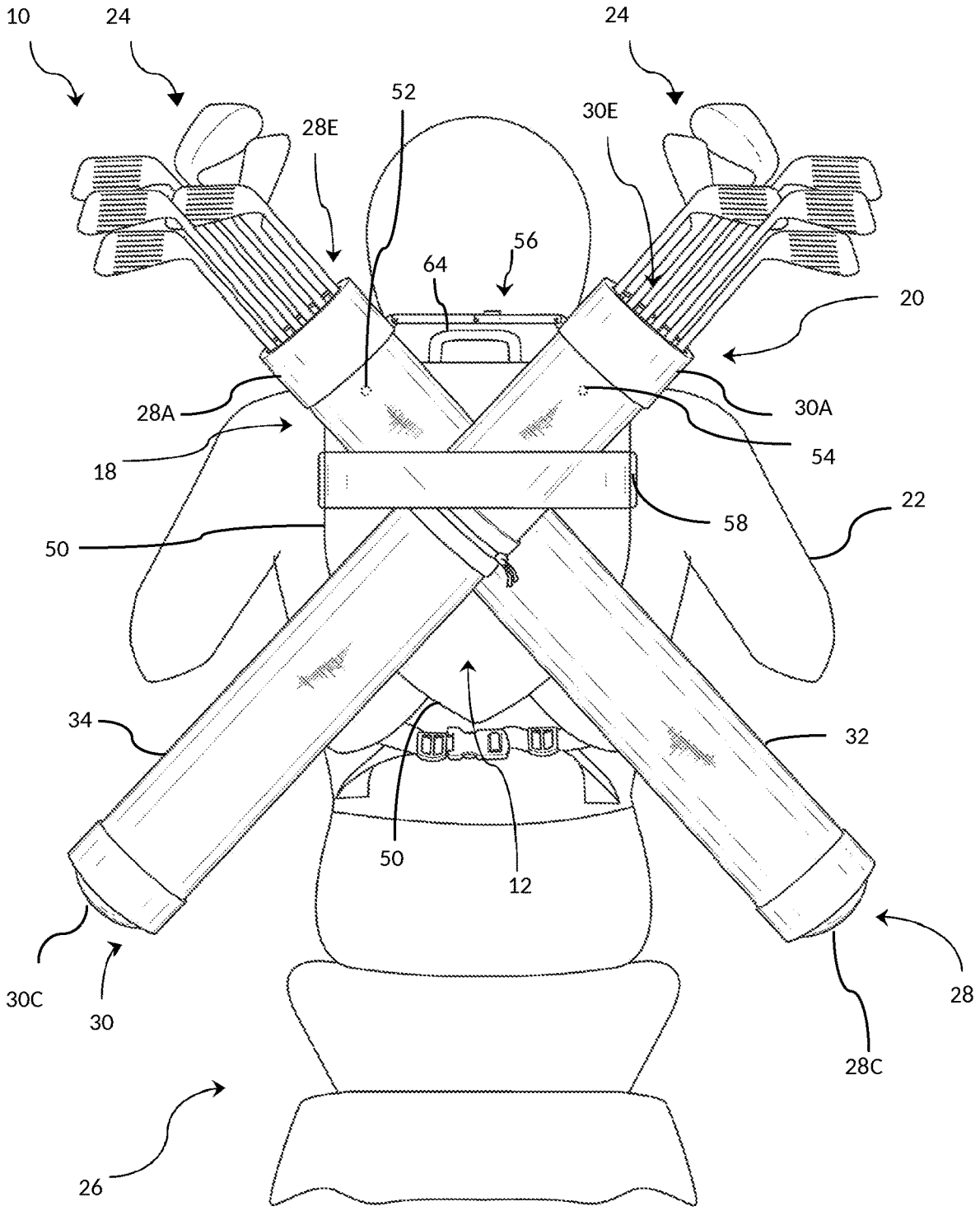
FIG. 1 is a view of a backpack being worn by a user, according to a first embodiment of the present invention.

Referring to the figures, wherein like numerals indicate like or corresponding parts throughout the several views, a backpack 10 for carrying sporting equipment is provided. In the illustrated embodiment, the backpack 10 is adapted to configured to carry golf clubs and related paraphernalia or equipment. In the illustrated embodiments, the backpack 10 includes a base 12, a harness 14, a hinge mechanism 16, a first cartridge 18, and a second cartridge 20. The harness 14 is coupled to the base 12 and is configured to be removably worn by a person 22.

As will be discussed in further detail below, the first cartridge 18 is configured to removably store at least one piece of sporting equipment, such as a golf club 24 and is rotatably coupled to the base 12 by the hinge mechanism 16. The second cartridge 20 configured to removably store at least one other piece of sporting equipment, such as another golf club 24 and is rotatably coupled to the base 12 by the hinge mechanism 16. The hinge mechanism 16 is coupled to the base 12 and is configured to allow each of the first and second cartridges 18, 20 to be rotated between an upright position (for example, as shown in FIGS. 2A, 2B, 2C, 5B, 5C and 6A) and a cross position (for example, as shown in FIGS. 1, 2F, and 3).

When the backpack 10 is in the upright position, the first and second cartridges 18, 20 are generally parallel and may be connected to a golf cart (not shown) or other device or vehicle or placed in a free-standing mode using a pair of legs (see below). When the backpack 10 is in the cross position, the first and second cartridges 18, 20 are in a transverse relationship. This shortens the overall height dimension, h, of the backpack 10 which makes the backpack 10 easier to wear and carry by the person 22. For example, the cross position or configuration makes it easier for the person 22 to carry the backpack 10 and sporting equipment 24, when the person is riding a bicycle, motorcycle, or other similar type vehicle 26.

In the illustrated embodiments, the first and second cartridges 18, 20 include a respective frame 28, 30 and a respective outer cover 32, 34. As shown more clearly in FIGS. 5A-5A and FIGS. 6A and 6H-6K, the frames 28, 30 may include a top member 28A, 30A, a bottom member 28C, 30C and at least one spine or framing member 28D, 30D are connected to the top and bottom members 28A, 30A, 228C, 30C to provide shape and structure to the cartridges 18, 20. In the illustrated embodiments, the frames 28, 30 may further include a middle member 28B, 30B. The outer covering 32, 34 of the first and second cartridges 18, 20 may be made from a mesh material or other flexible material. The backpack 10 may include separate bag(s) or compartment(s) (see below) for holding other items or accessories, e.g., gloves, golf balls, tees, etc. . . . The bag(s) may be a separate item that removable connects to the backpack and/or may include bags or compartments integrated with the outer cover 32, 34 of one or both of the cartridges 18, 20. As discussed in more detail below, each cartridge 18, 20 may include a plurality of predefined inner lanes 28E, 30E that are sized and configured to receive a respective piece of sporting equipment 24. In one aspect of the present invention, the inner lanes 28E, 30E are defined, at least in part, by the top members 28A, 30A of the first and second cartridges 18, 20, respectively. Further, as shown, the harness 14 may include a pair of padded shoulder straps 14A, 14B. The components of the backpack 10 may be made from any number of suitable materials, including but not limited to a metal, for example, aluminum, plastic, wood, natural textiles, synthetic textiles, leather, fibers, composite materials, real or synthetic rubbers, any suitable materials, and combinations thereof.

First Embodiment

With reference to FIGS. 2A-2F, a backpack 10 configured to carry sporting equipment 24 in the form of golf clubs, according to a first embodiment is shown. In the first embodiment, the base 12 includes a foundation plate 50 which may be composed from plastic. The foundation plate 50 may be in the shape of a shield, i.e., wide at the top and narrowing towards the bottom. This provides maximum coverage for the shoulder blades of the person 22. Ideally, the foundation plate 50 may be designed to be fully covered by, i.e., no bigger or smaller than, the torso of the person 22 so as to not increase wind resistance. The shoulder straps 14A, 14B of the harness 14 may be coupled or fixed to the foundation plate 50. As shown, the shoulder straps 14A, 14B are adjustable and may include upper and lower interconnecting straps 14C, 14D to assist maintaining the shoulder straps 14A, 14B in place when the backpack 10 is being worn.

Figure 2A:
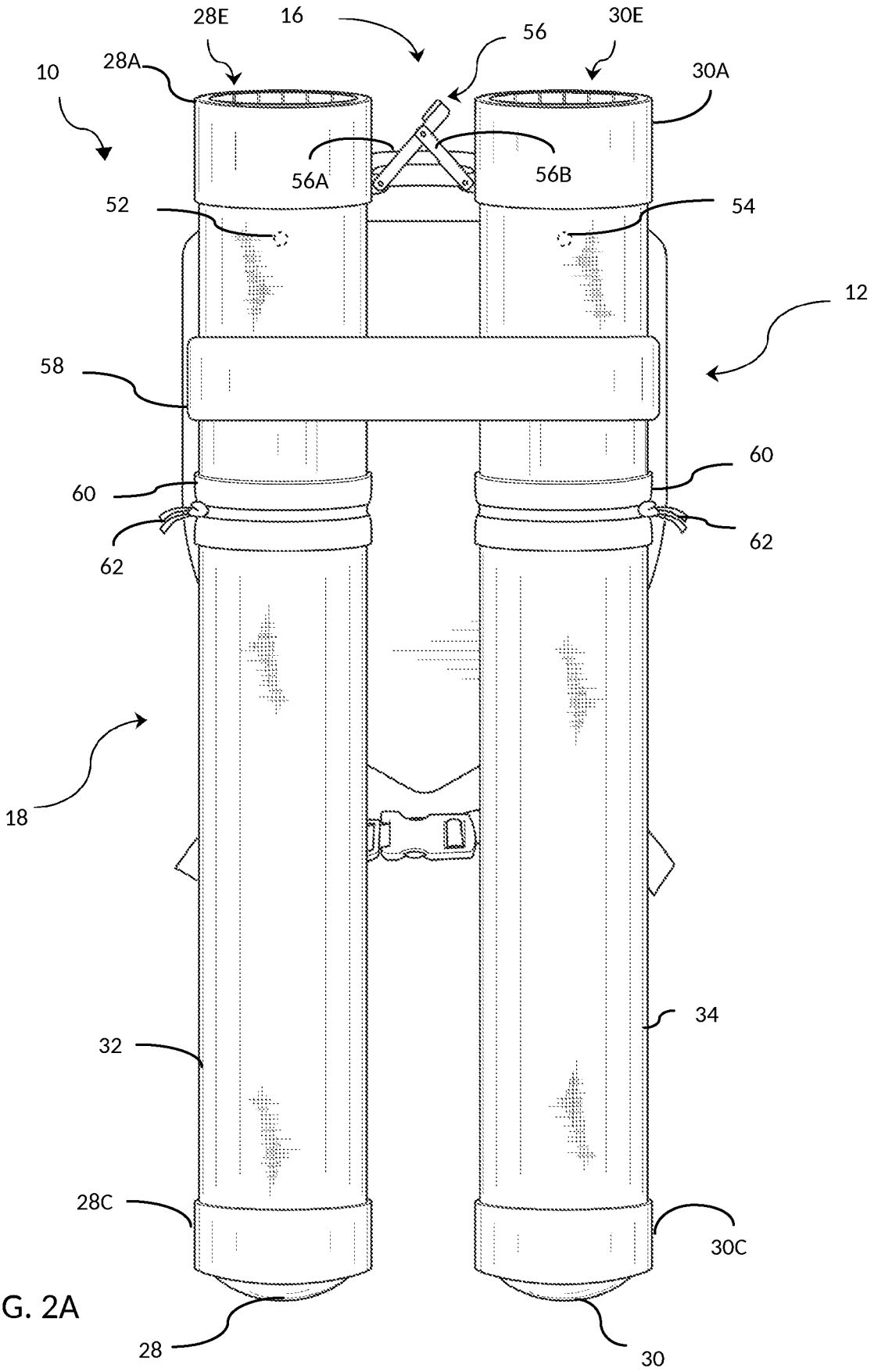
FIG. 2A is a rear view of the backpack of FIG. 1.
Figure 2B:
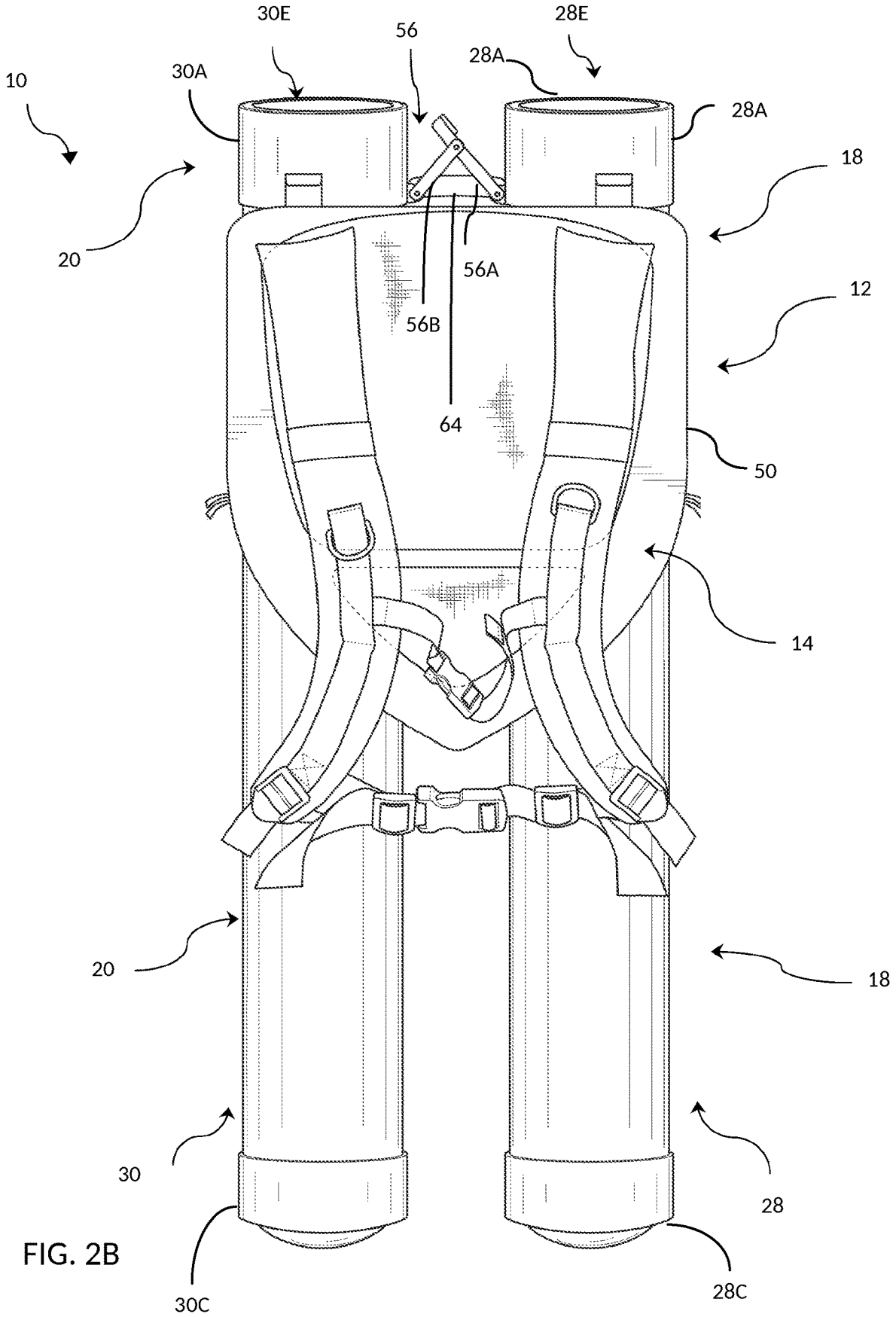
FIG. 2B is a front view of the backpack of FIG. 1.
Figure 2C:
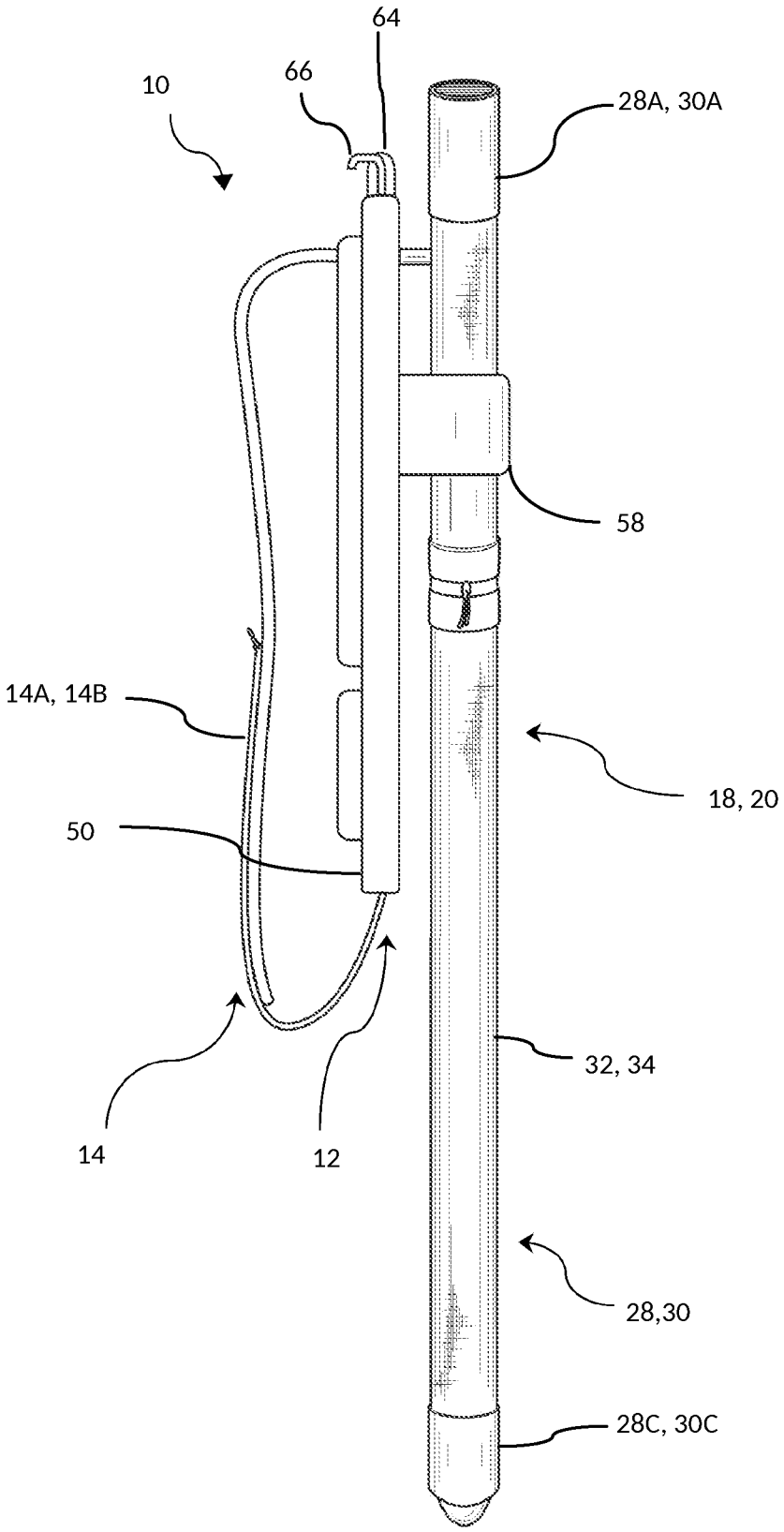
FIG. 2C is a side view of the backpack of FIG. 1.
Figure 2D:
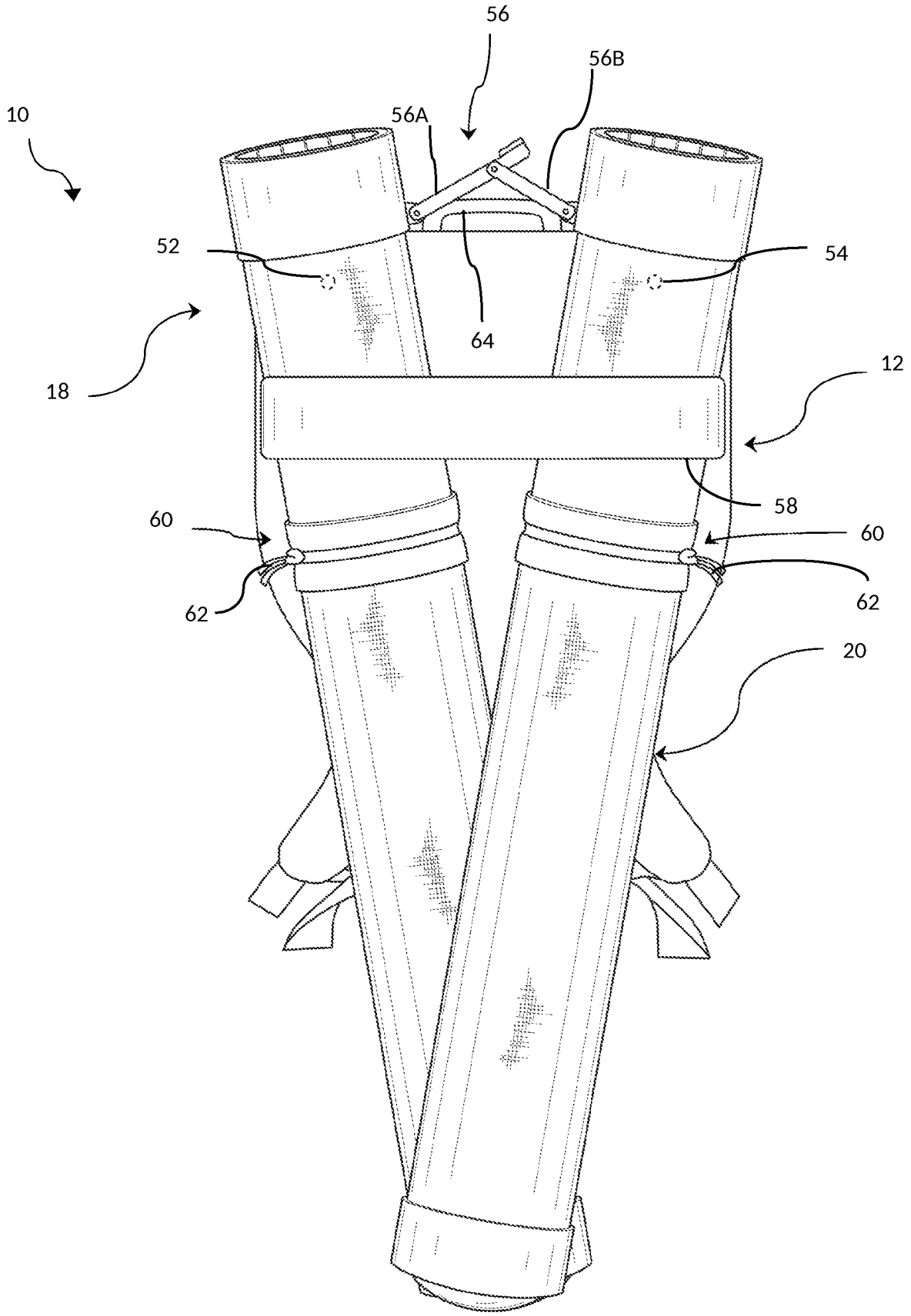
FIG. 2D is a second rear view of the backpack of FIG. 1.
Figure 2E:
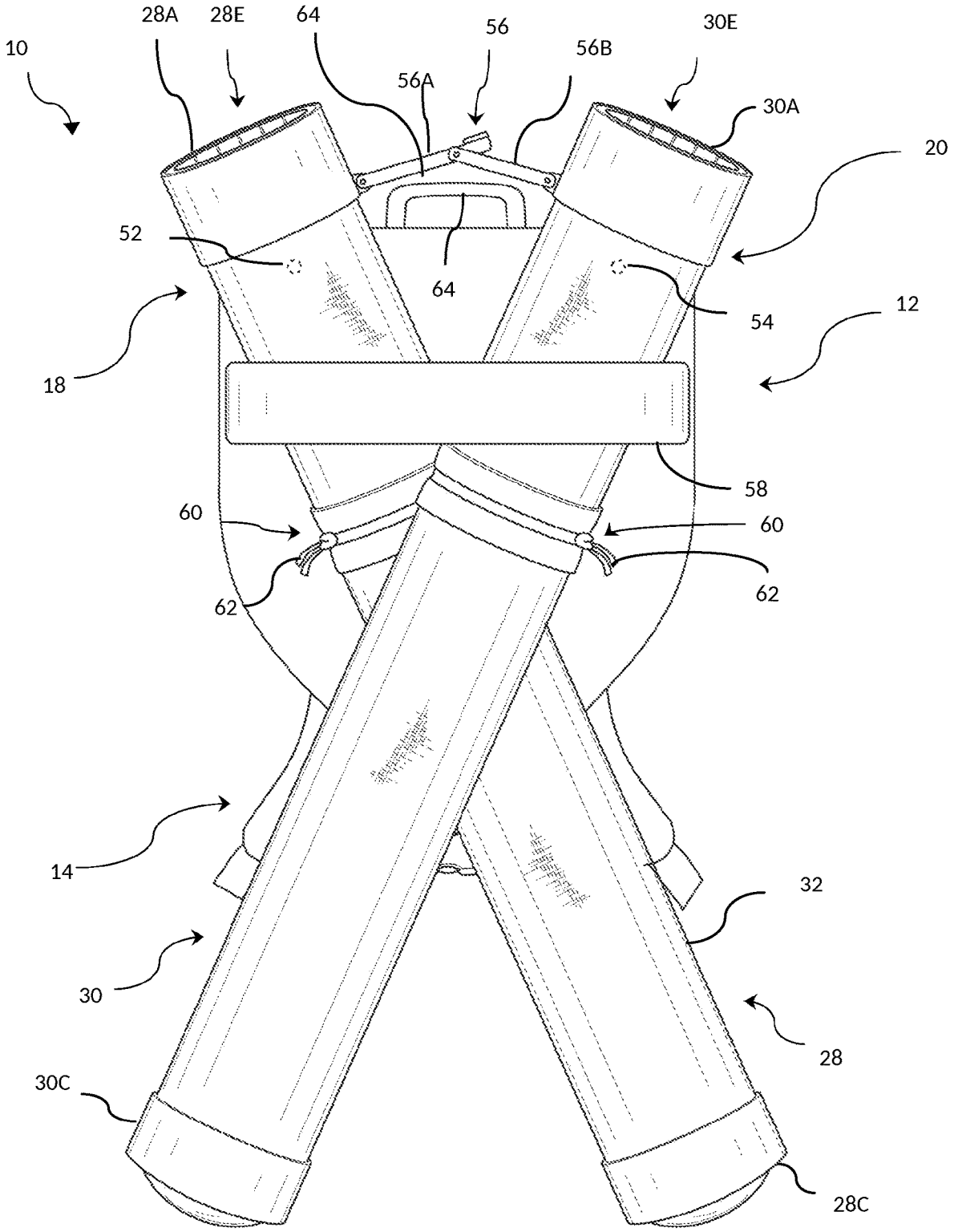
FIG. 2E is a third rear view of the backpack of FIG. 1.
Figure 2F:
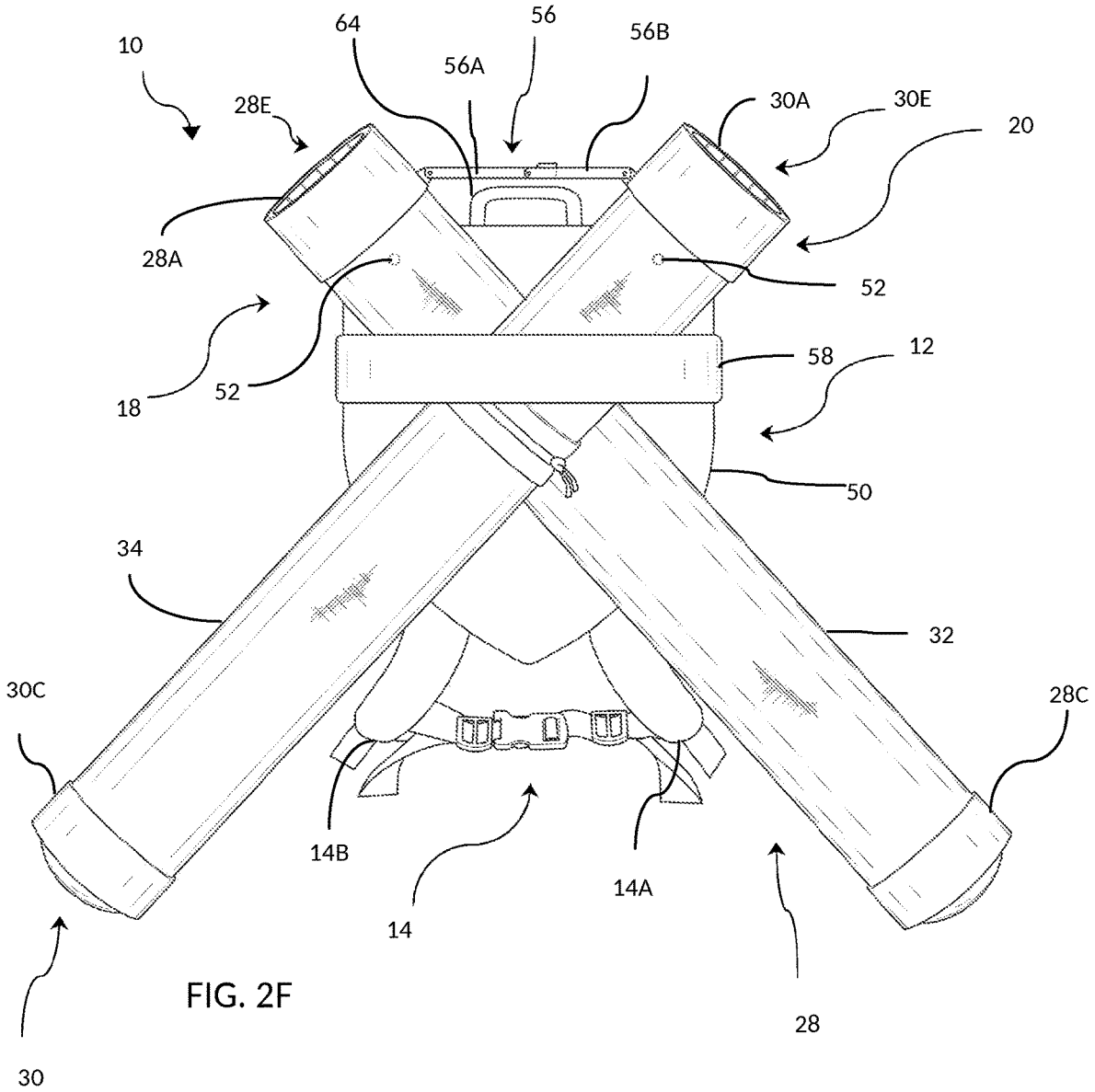
FIG. 2F is a fourth rear view of the backpack of FIG. 1.
Figure 3:
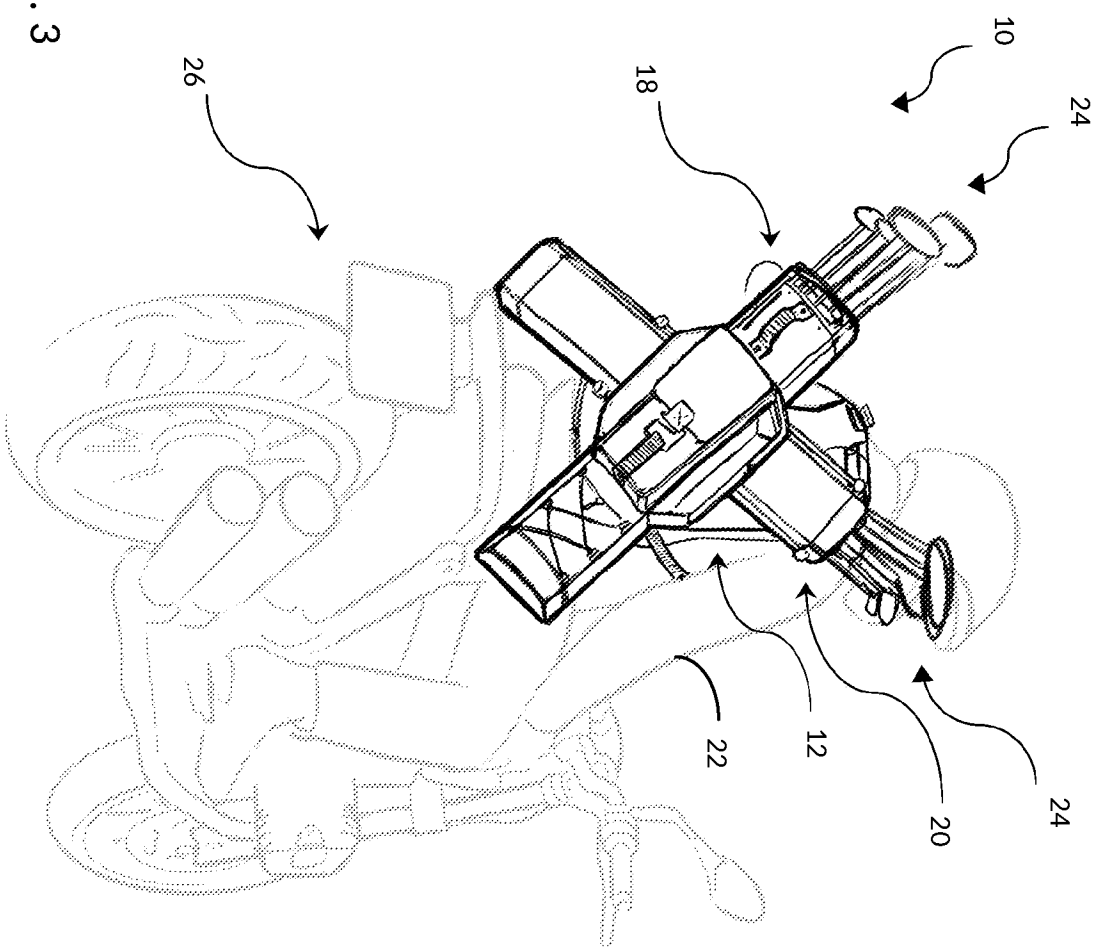
FIG. 3 is a perspective view of a backpack being worn by a user, according to a second embodiment of the present invention.
Figure 4A:
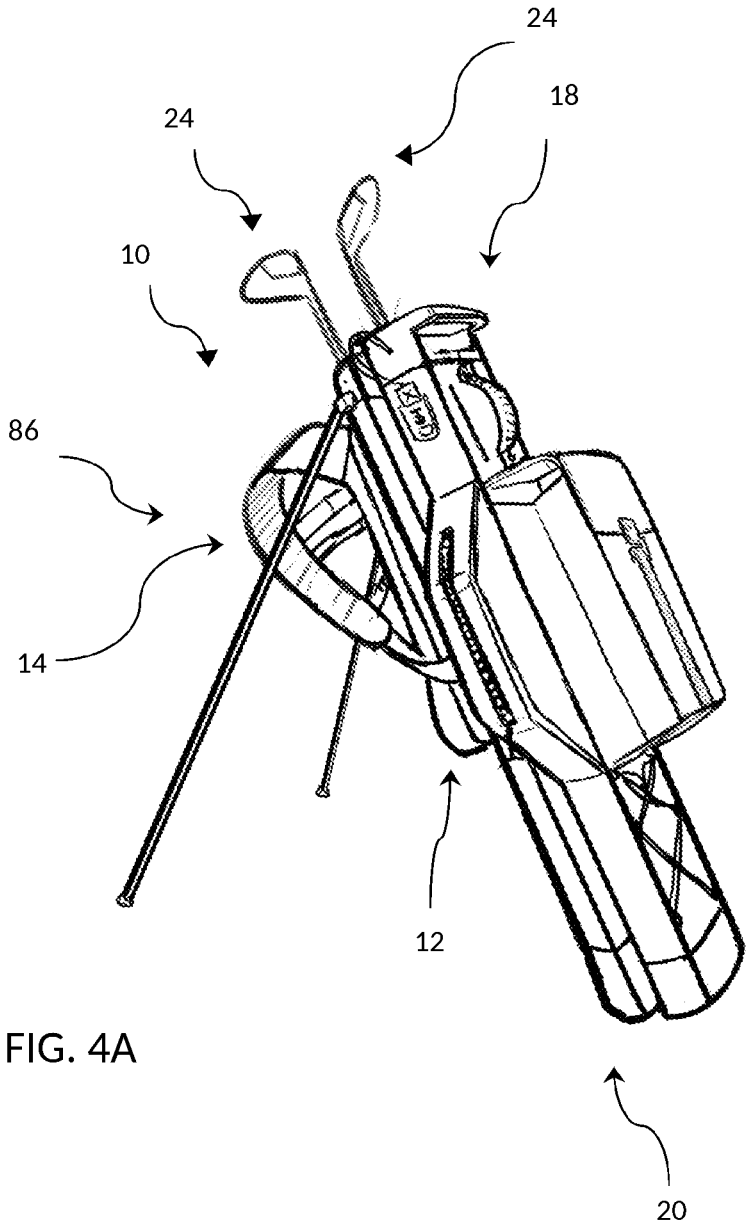
FIG. 4A is a second perspective view of the backpack of FIG. 3.
Figure 4B:
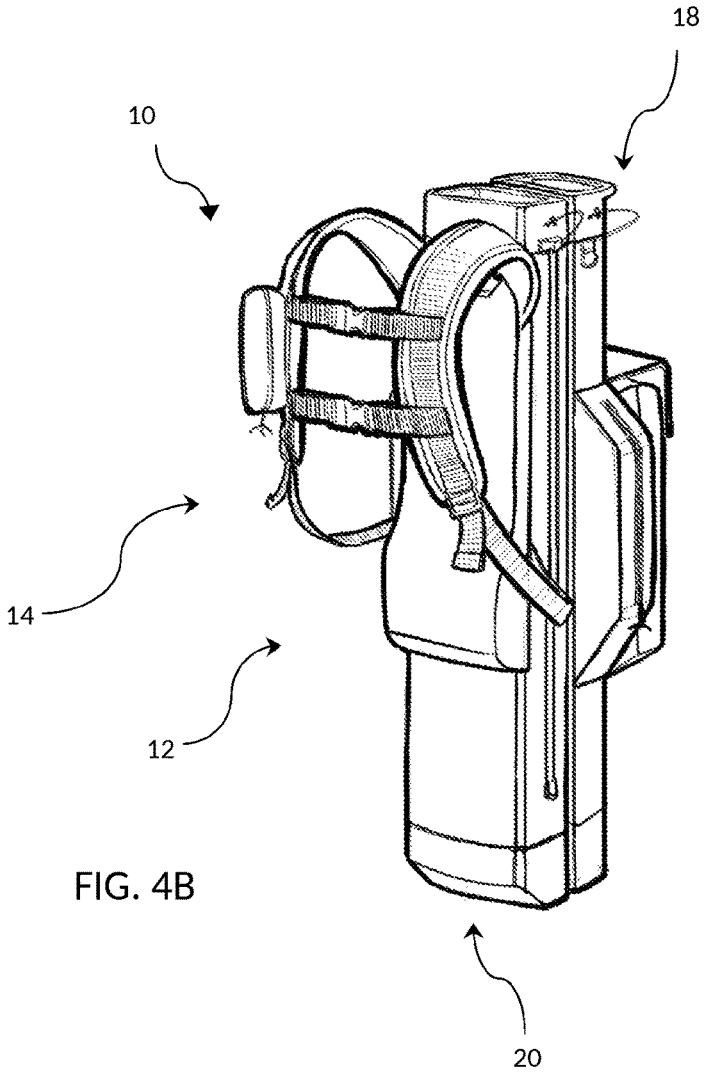
FIG. 4B is a third perspective view of the backpack of FIG. 3.
Figure 4C:
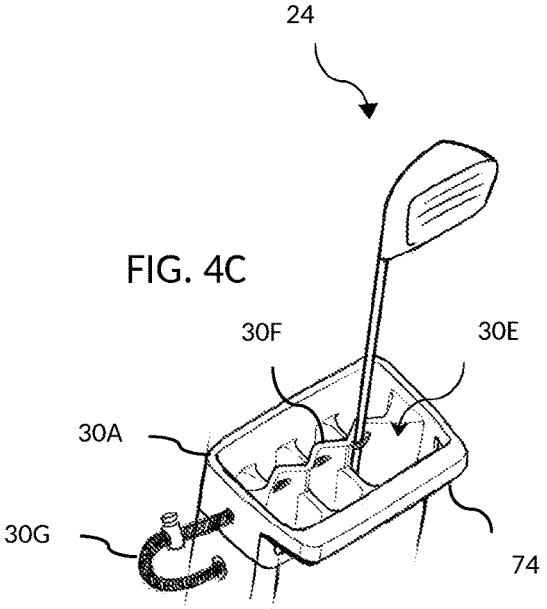
FIG. 4C is a partial perspective view of the backpack of FIG. 3.

As shown, in the first embodiment when the first and second cartridges 18, 20 are in the upright position (as shown in FIG. 2A). the first and cartridges 18, 20 are generally parallel in a side-by-side arrangement with both being, adjacent the foundation plate 50.

In the illustrated embodiment of the first embodiment, the hinge mechanism 16 includes first and second fasteners 52, 54 and a locking brace 56. The first and second fasteners 52, 54 may include a bolt and nut and may be composed from plastic. As shown, the first and second cartridges 18, 20 may be rotatably coupled to the foundation plate 50 of the base 12 by the first and second fasteners 52, 54, respectively. As discussed above, the fasteners 52, 54 allow the first and second cartridges 18, 20 to rotate (about the fasteners 52, 54) between the upright position and the cross position. As shown in FIGS. 1 and 2F, when the first and second cartridges 18, 20 are in the cross position a lower portion of one of the first and second cartridges 18, 20 crosses behind (relative to the base 12) a lower portion of the other of the first and second cartridges 18, 20.

The locking brace 56 includes a first brace member 56A having a first end rotatably coupled to the first cartridge 18 and a second brace member 56B having a first end rotatably coupled to the second cartridge 20. The first and second brace members 56A, 56B are rotatably coupled together at second ends. The locking brace 56 is moveable between a locked (or fully extended) position and an unlocked position. With reference to FIG. 2F, when the locking brace 56 is in the locking or full extended position, the first and second cartridges 18, 20 are in the cross position.

The first and second cartridges 18, 20 may be released from the cross position by unlocking the brace 56 by raising a center portion of the brace 56. This action shortens the length of the brace 56 resulting in a top end of the first and second cartridges 18, 20 being drawn together thus towards the upright positions (see FIGS. 2D-2F).

A retainer 56 may be provided that is coupled to the base 12 (or the foundation plate 50 of the base 12). The retainer 56 defines first and second lanes that are configured to receive the first and second cartridges 18, 20. The retainer 56 may be adjustable such that the retainer 56 may be tightened down to keep the first and second cartridges 18, 20 in place (whether in the upright position, the cross position or some position therebetween).

Each of the first and second cartridges 18, 20 may further include respective padded cinches 60 and respective drawstring ties 62 sitting on top of the respective padded cinch 60. Once the sporting equipment or golf clubs 24 have been inserted into the first and/or second cartridges 18, 20, the drawstring ties 62 may be tightened to assist in maintaining the sporting equipment 24 in place.

A handle 64 may be provided at the top of the foundation plate 50 to allow for the backpack 10 to be carried or raised. A pair of mounting clips 66 may also be located adjacent the top of the foundation plate 50. The clips 66 allow the backpack to be removably mounted to an external support structure, e.g., a back of a golf cart (not shown).

The foundation plate 50, and the shoulder straps 14A, 14B may be padded for extra comfort and lumbar support. The cinching strap 58 and the interconnecting straps 14C, 14D may utilize slides, clips, side release buckles, connecting buckling clips, ladder lock sliders, buckles or other suitable devices to adjust a length thereof.

In the illustrated embodiment, the first and second cartridges 18, 20 are tubular with a circular cross-section. However, the present invention is not limited to any specific shape for the first and second cartridges 18, 20.

Second Embodiment

With reference to FIGS. 3, 4A-4C, and 5A-5Q, in which like parts are numbered the same as in the first embodiment, a backpack 10 configured to carry sporting equipment, such as a golf clubs, according to a second embodiment is shown. In the second embodiment, the first and second cartridges 18, 20 have a generally rectangular cross-section. As discussed above, the backpack 10 of the second embodiment includes a hinge mechanism 16 that allows the first and second cartridges 18, 20 to be moveable between an upright position (shown in FIGS. 4, 5B and 5C) and a cross position (shown in FIG. 3).

As shown, in the second embodiment when the first and second cartridges 18, 20 are in the upright position (as shown in FIG. 4), the first and cartridges 18, 20 are generally parallel. The first cartridge 18 is adjacent to the base 12 and the second cartridge 20 is adjacent the first cartridge 18 on an opposite side of the first cartridge 18 relative to the base 12. As shown the first cartridge 18 is located between the second cartridge 20 and the base 12.

As will be discussed in more detail below, in the second embodiment the hinge mechanism 16 includes a first rotational device 70 and a second rotational device 72. The first cartridge 18 is coupled to the base 12 by the first rotational device 70 and the second cartridge 20 is coupled to the first cartridge 18 by the second rotational device 72. The first rotational device 70 is configured to allow the first cartridge 18 to be rotated between the upright position and the cross position of the first cartridge 18. The second rotational device 72 is configured to allow the second cartridge 20 to be rotated between the upright position and the cross position of the second cartridge 20.

As will be discussed in more detail below, the first rotational device 70 includes a first inside gear 70A and a second inside gear 70B. The first inside gear 70A is fixed to the base 12 and the second inside gear is fixed to the first cartridge 18. In the illustrated embodiment, the first inside gear 70A and the second inside gear 70B are engaged to provide the first cartridge 18 with a plurality of discrete positions between the upright position and the cross position of the first cartridge 18 relative to the base 12.

The second rotational device 72 includes a first outside gear 72A and a second outside gear 72B. The first outside gear is fixed to the first cartridge 18 and the second outside gear 72B is fixed to the second cartridge 20. The first outside gear 72A and the second outside gear 72B are engaged to provide the second cartridge 20 with a plurality of discrete positions between the upright position and the cross position of the second cartridge 20 relative to the first cartridge 18.

As discussed above, the first cartridge 18 includes a frame 28 and an outer covering 32 and the second cartridge 20 includes a frame 30 and an outer covering 34.

With specific reference to FIGS. 5B, 5C, and 5J-5O, in the second embodiment the frame 28 of the first cartridge 18 includes a top member 28A, a middle member 28B, and a bottom member 28C and a plurality of framing members 28D. Each of the top member 28A, the middle member 28B, and the bottom member 28C have a generally cuboid shape.

Figure 5A:
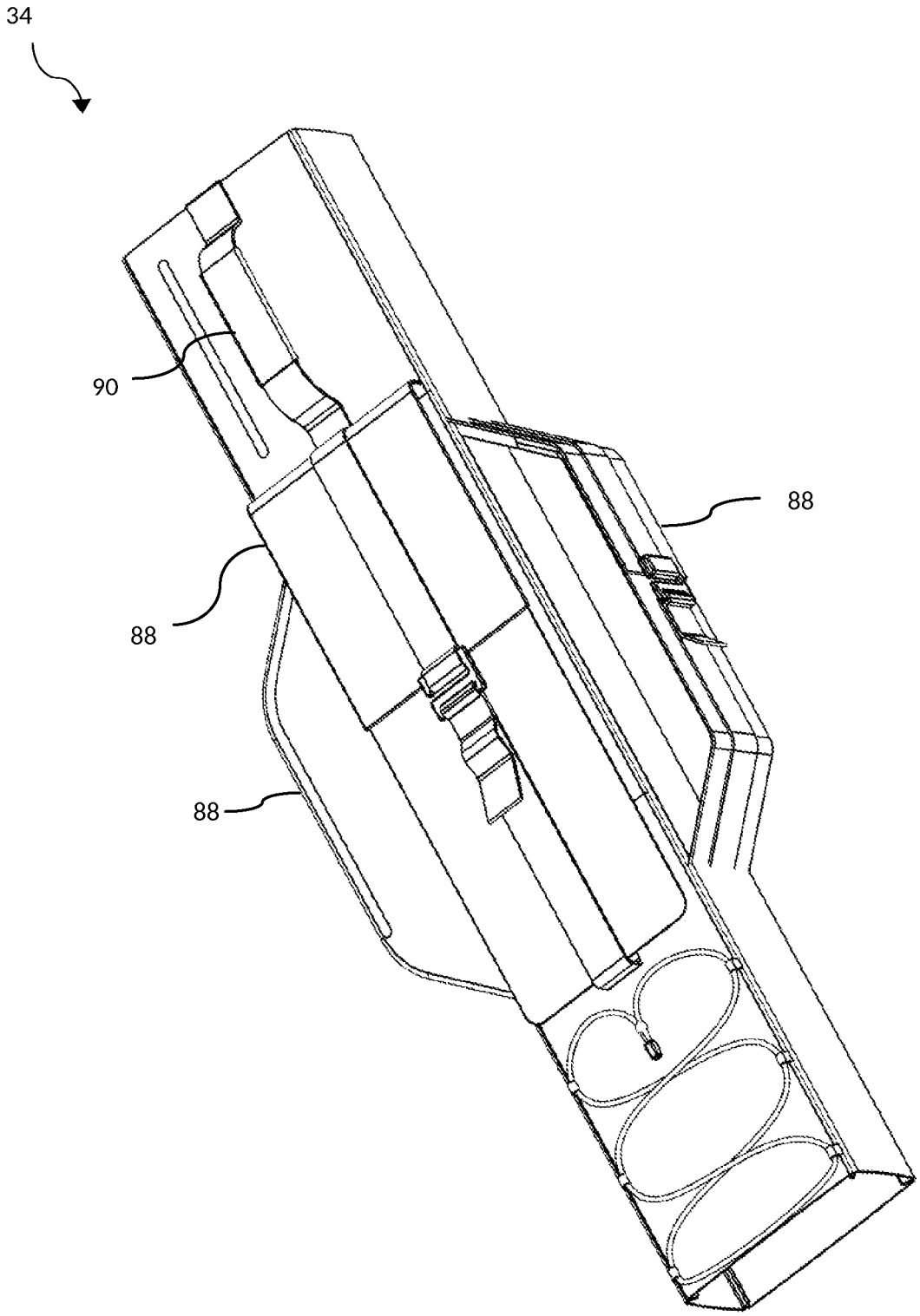
FIG. 5A is a perspective view of an outer covering of the backpack of FIG. 3.
Figure 5B:
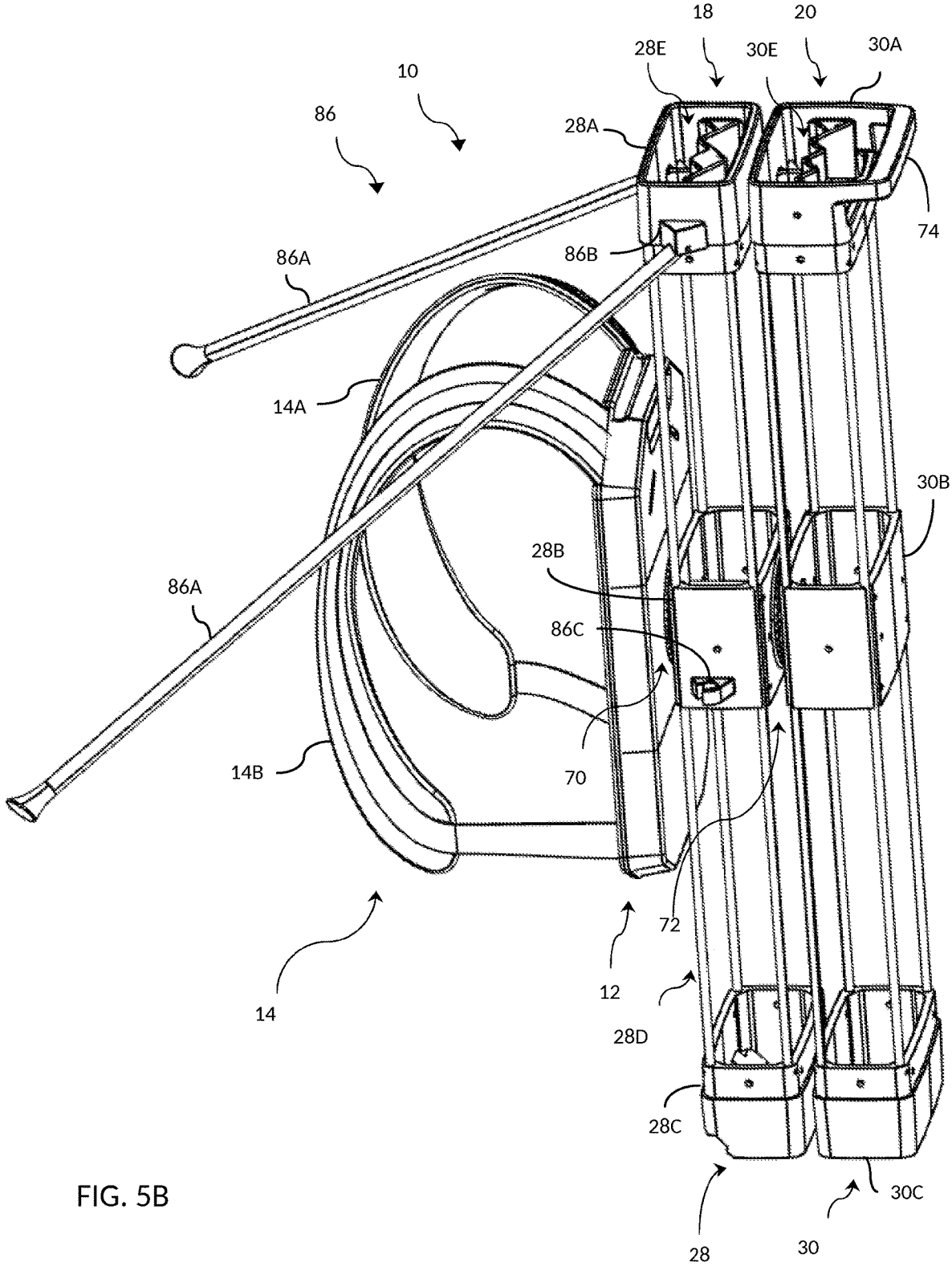
FIG. 5B is a perspective view of the backpack of FIG. 3 without the outer covering.
Figure 5C:
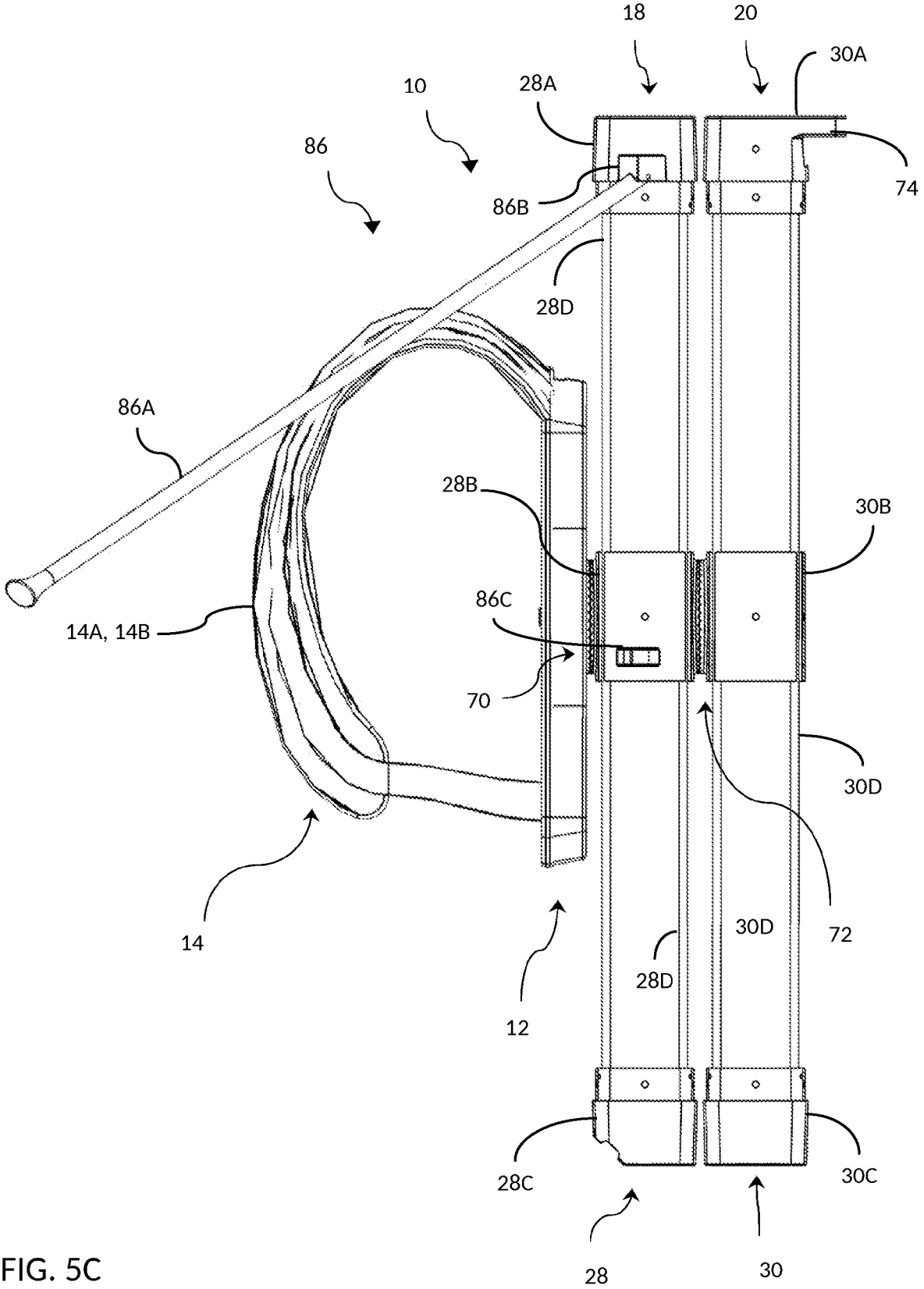
FIG. 5C is a side view of the backpack of FIG. 3 without the outer covering.
Figure 5D:
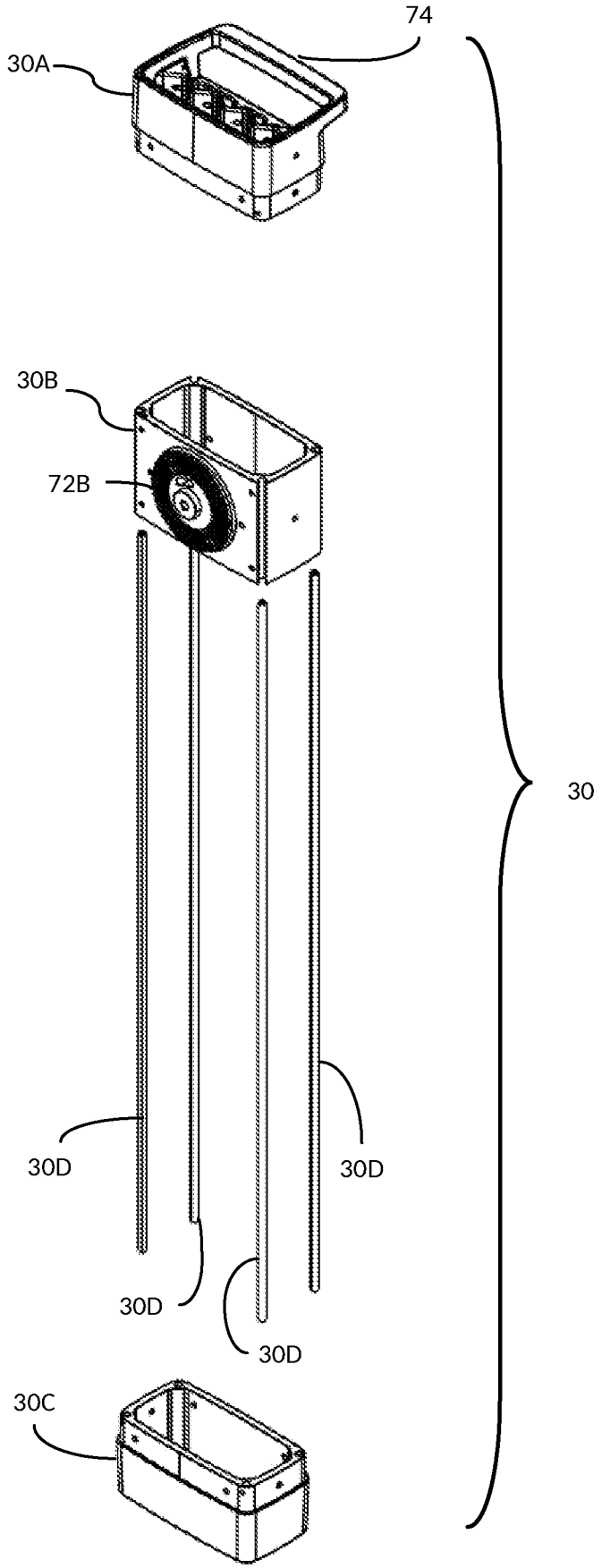
FIG. 5D is an exploded view of a frame of a first cartridge of the backpack of FIG. 3.
Figure 5E:
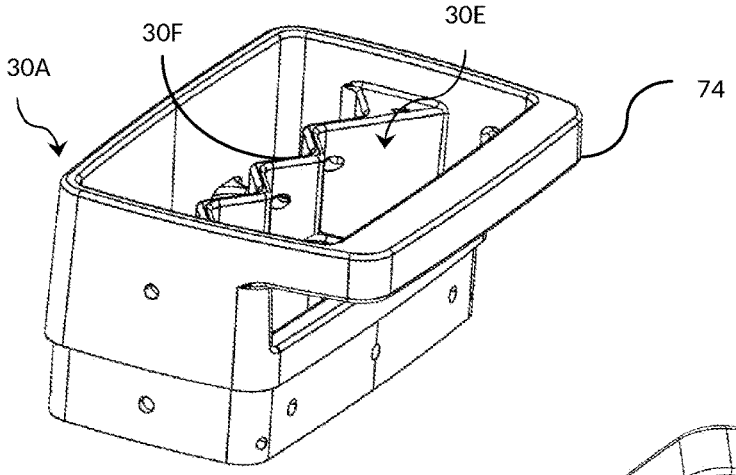
FIG. 5E is a first perspective view of a top member of the frame of the first cartridge of the backpack of FIG. 3.
Figure 5F:
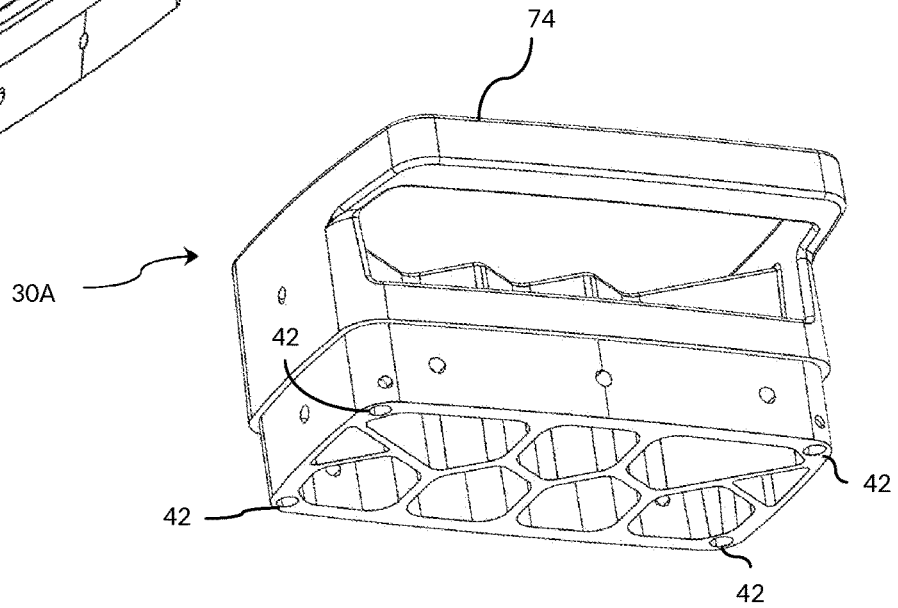
FIG. 5F is a second perspective view of the top member of the frame of the first cartridge of the backpack of FIG. 3.
Figure 5G:
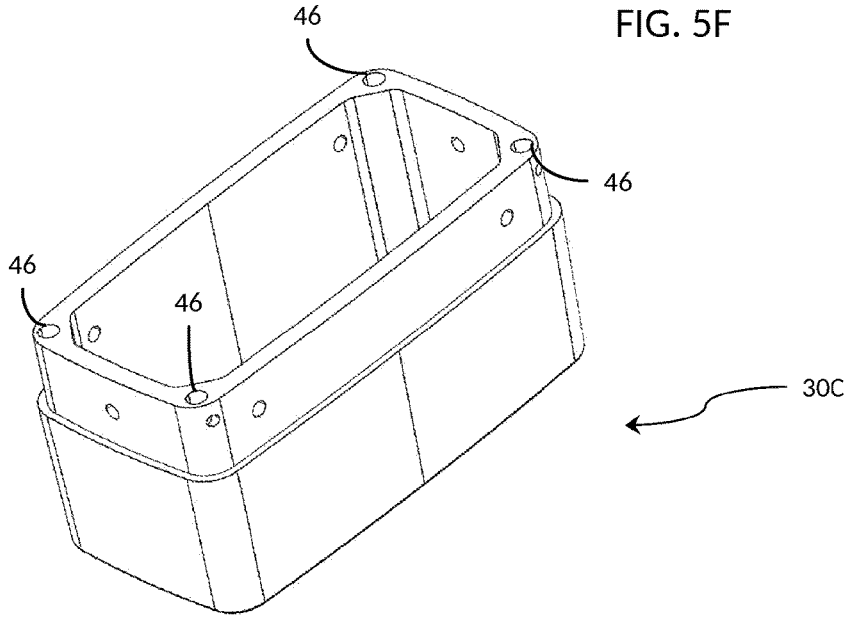
FIG. 5G is a perspective view of as bottom member of the frame of the first cartridge of the backpack of FIG. 3.
Figure 5H:
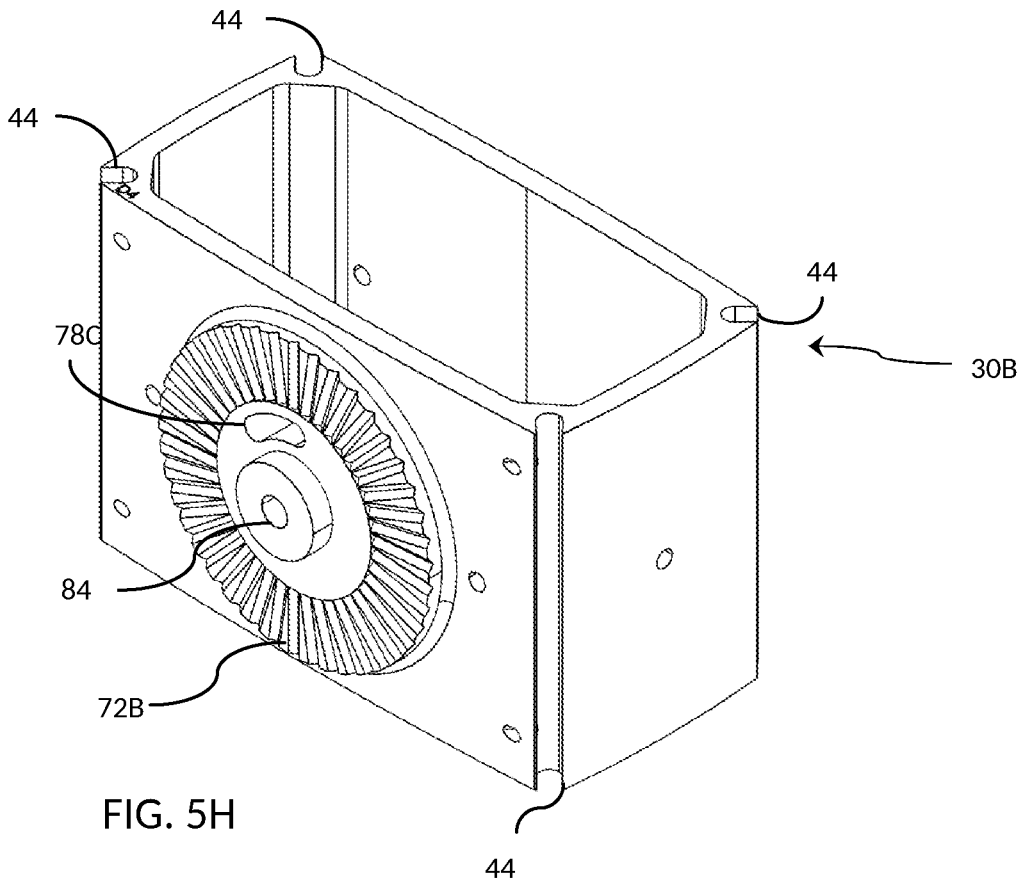
FIG. 5H is a perspective view of a middle member of the frame of the first cartridge of FIG. 5D.
Figure 5I:
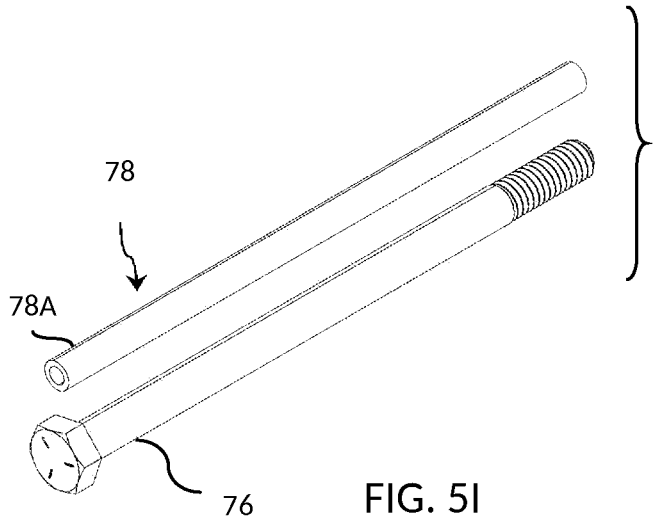
FIG. 5I is a perspective view of a portion of a restraining device of the backpack of FIG. 3, according to an embodiment of the present invention.
Figure 5J:
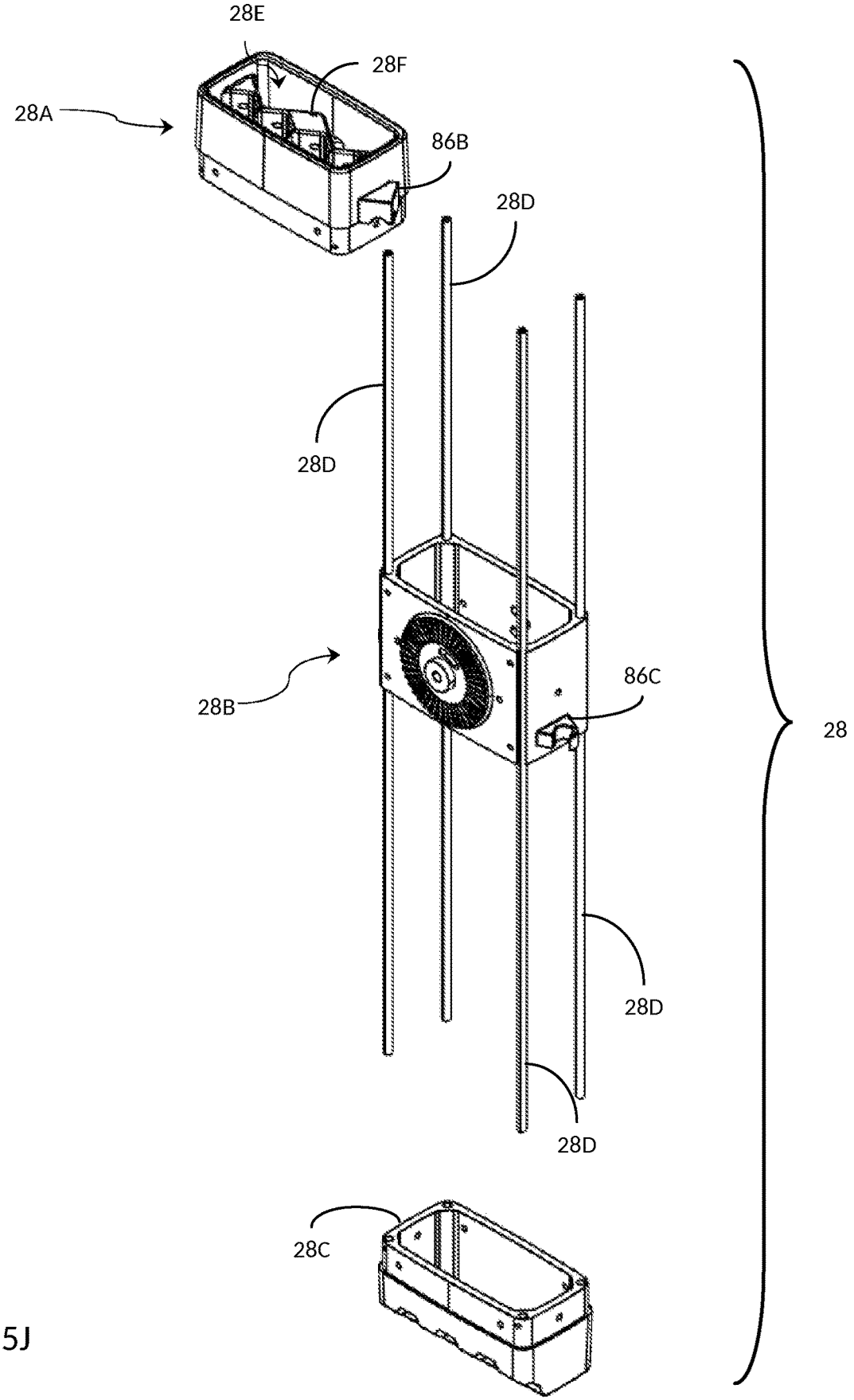
FIG. 5J is an exploded view of a frame of a second cartridge of the backpack of FIG. 3.
Figure 5K:
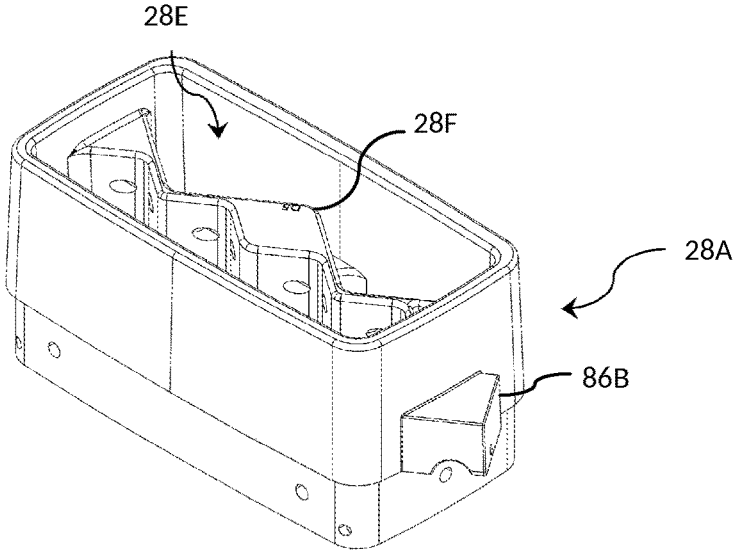
FIG. 5K is a first perspective view of a top member of the frame of the second cartridge of the backpack of FIG. 3.
Figure 5L:
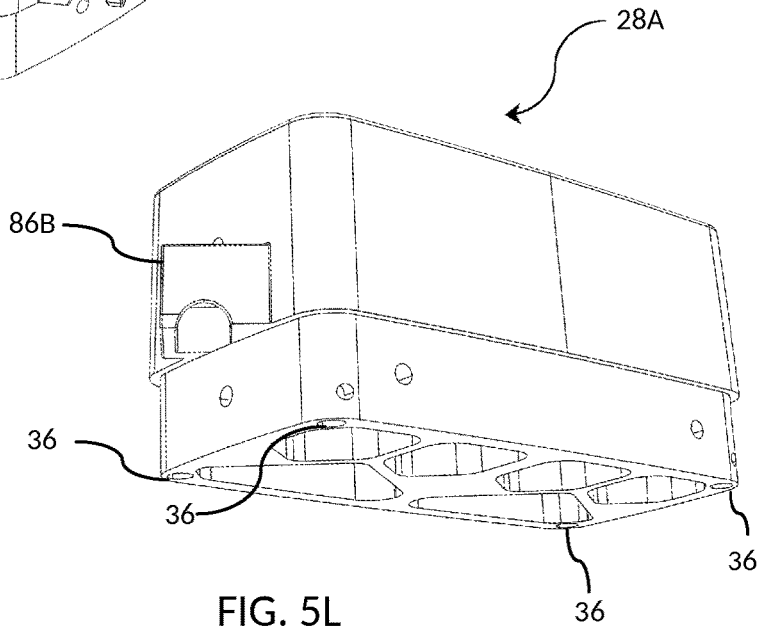
FIG. 5L is a second perspective view of the top member of the frame of the second cartridge of the backpack of FIG. 3.
Figure 5M:
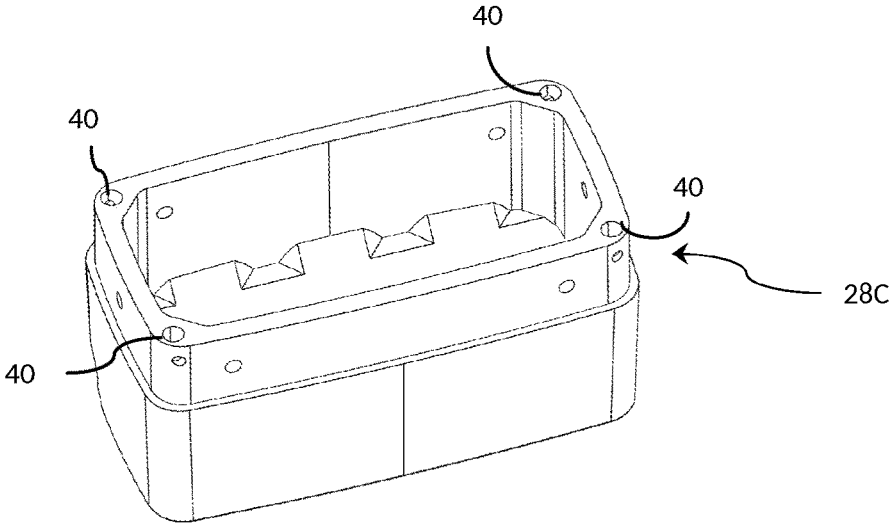
FIG. 5M is a perspective view of as bottom member of the frame of the second cartridge of the backpack of FIG. 3.
Figure 5N:
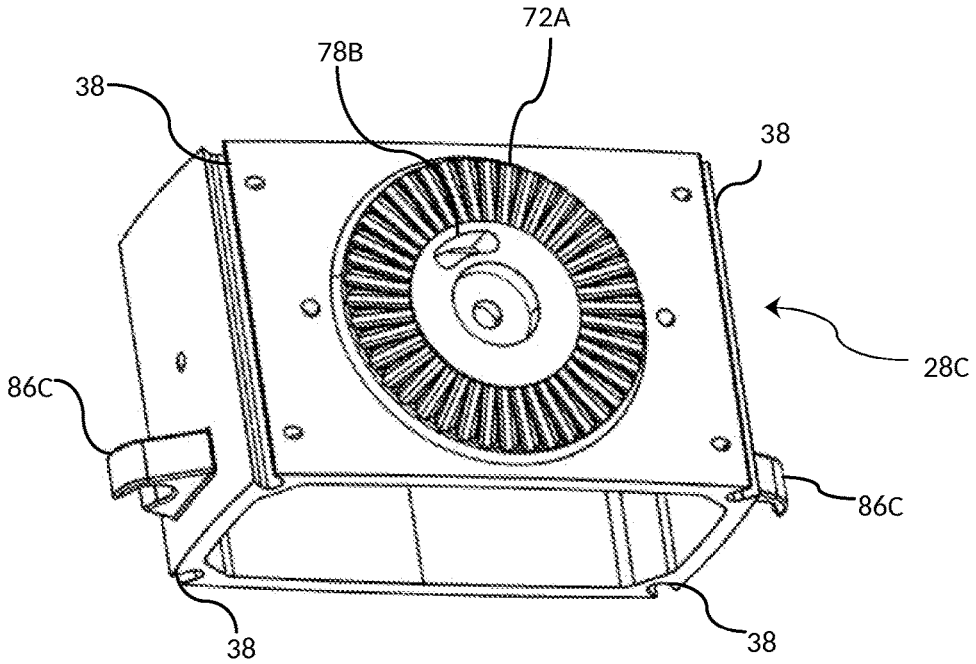
FIG. 5N is a first perspective view of a middle member of the frame of the second cartridge of FIG. 5L.
Figure 5O:
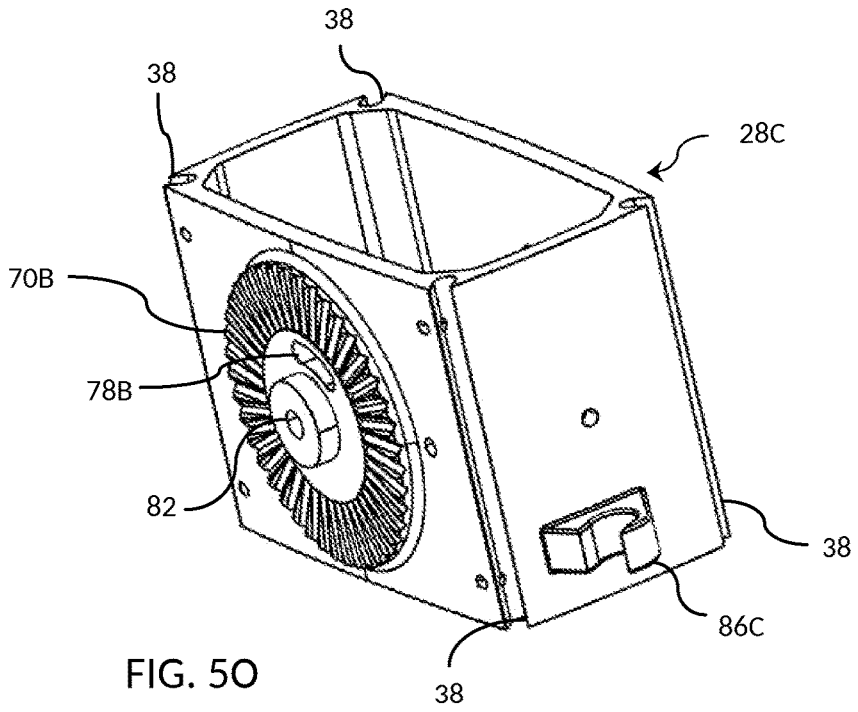
FIG. 5O is a second perspective view of the middle member of the frame of the second cartridge of FIG. 5L.

In the illustrated embodiment, the frame 28 of the first cartridge 18 includes four framing members 28D. The top member 28A of the frame 28 of the first cartridge 18 includes a plurality of apertures 36 (FIG. 5L) in a bottom surface thereof. The middle member 28B of the frame 28 of the first cartridge 18 includes a plurality of slots 38 located at the four corners of the middle member 28B of the first cartridge 18 (FIGS. 5N and 5O). The bottom member 28C of the frame 28 of the first cartridge 18 includes a plurality of apertures 40 located in a top surface thereof (FIG. 5M). The apertures 36 of the top member 28A is configured to receive a top end of one of the framing members 28D. The apertures 40 of bottom member 28C is configured to receive a bottom end of on of the framing members 28D. The slots 38 at the corners of the middle member 28B is configured to receive a middle portion of one of the four framing members 28D to form the general cuboid shape of the first cartridge 18. In the illustrated embodiment the framing members 28D may be snapped or pushed into the apertures 36, 40 and the slots 38 of the members 28A, 28B, 28C and may be retained therein via a friction fit, fasteners, an adhesive, a combination thereof, or any suitable means.

With specific reference to FIGS. 5B, 5D and 5E-5H, in the second embodiment the frame 30 of the second cartridge 20 includes a top member 30A, a middle member 30B, and a bottom member 30C and a plurality of framing members 30D. Each of the top member 30A, the middle member 30B, and the bottom member 30C have a generally cuboid shape.

In the illustrated embodiment, the frame 30 of the second cartridge 20 includes four framing members 30D. The top member 30A of the frame 30 of the second cartridge 20 includes a plurality of apertures 42 is a bottom surface thereof (FIG. 5F). The middle member 30B of the frame 30 of the second cartridge 20 includes a plurality of slots 44 located at the four corners of the middle member 30B of second cartridge 20 (FIG. 5H). The bottom member 30C of the frame 30 of the second cartridge 20 includes a plurality of apertures 46 located in a top surface thereof (FIG. 5G). The apertures 42 of the top member 30A is configured to receive a top end of one of the framing members 30D. The apertures 46 of bottom member 30C is configured to receive a bottom end of on of the framing members 30D. The slots 44 at the corners of the middle member 30B is configured to receive a middle portion of one of the four framing members 30D to form the general cuboid shape of the second cartridge 20. In the illustrated embodiment the framing members 30D may be snapped or pushed into the apertures 42, 46 and the slots 44 of the members 30A, 30B, 30C and may be retained therein via a friction fit, fasteners, an adhesive, a combination thereof, or any suitable means. In the illustrated embodiment, a handle 74 may be integrally formed with top member 30A of the frame 30 of the second cartridge 20.

Figure 5P:
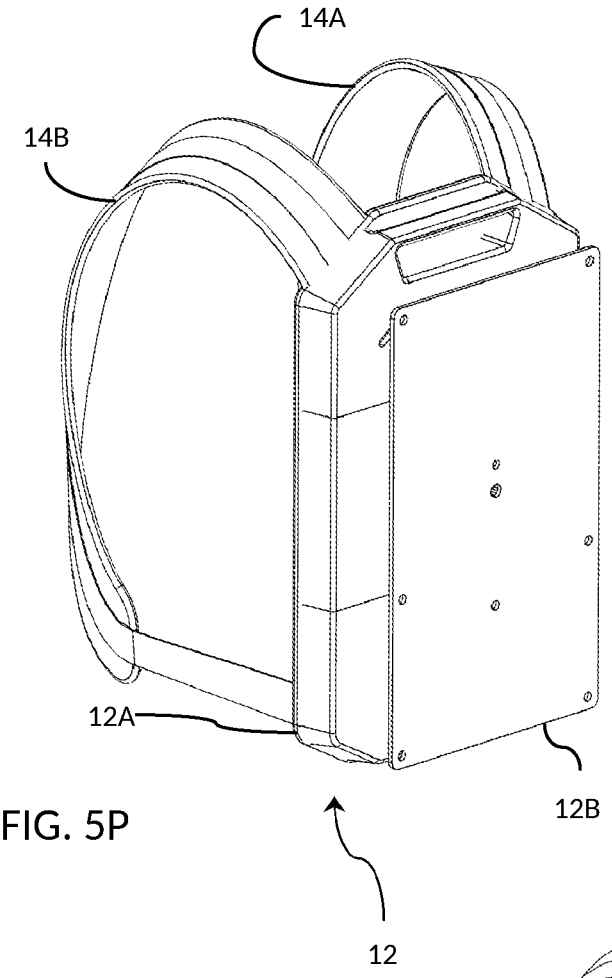
FIG. 5P is a perspective of a portion of the backpack of FIG. 3.
Figure 5Q:
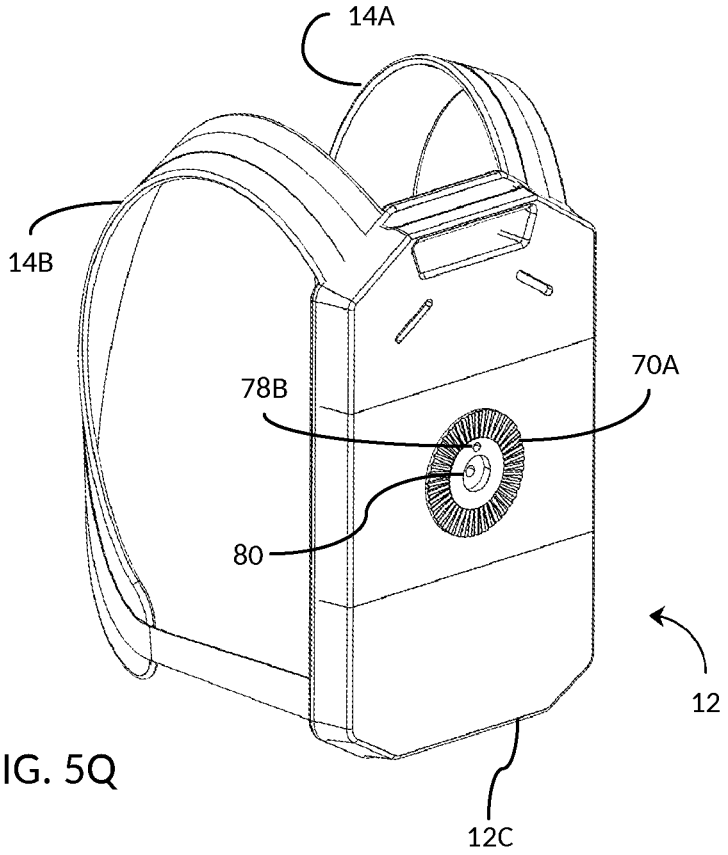
FIG. 5Q is a perspective of another portion of the backpack of FIG. 3.

With reference to FIGS. 5P-5Q, in the illustrated embodiment, the base 12 may include a harness portion 12A, a foundation plate 12B, and a base plate 12C. The harness 14 is connected to the harness portion 12A. The (optional) foundation plate 12B is composed from a stiff material such as a metal and provides shape and structure to the base 12. The foundation plate 12B is positioned between the harness portion 12A and the base plate 12C. The harness portion 12A, the foundation plate 12B, and the base plate 12C may be assembled together to form the base 12 via a plurality of fasteners and/or clips (not shown).

In aspect of the present invention, the top, middle and bottom members 28A, 28B, 28C, 30A, 30B, 30C and the framing members 28D, 30D of the frame 28, 30, the first and second cartridges 18, 20, may be composed by or from a plastic material, fiberglass tube stock, carbon fiber, metal rods, or any suitable material. The first inside gear 70A and the base plate 12C may be integrally formed. The second inside gear 70B, the middle member 28B of the frame 28 of the first cartridge 18, and the first outside gear 72A may be integrally formed. The second outside gear 72B and the middle member 30B of the frame 30 of the second cartridge 20 may be integrally formed.

The base 12, the middle member 28B of the first cartridge 18, and the middle member 30B of the second cartridge 20 are rotatably coupled together by a fastener 76 (see FIG. 5I) inserted through respective apertures 80, 82, 84.

The backpack 10 may include a restraining device 78 coupled to the first and second rotational devices 70, 72 and configured to limit movement of the first cartridge 18 relative to the base 12 and to limit movement of the second cartridge 20 relative to the base 12. In one aspect of the present invention, the restraining device 78 includes a restraining pin 78A. One of the restraining pin 78A is positioned (via a friction fit) in a restraining aperture 78B located within the base plate 12C (see FIG. 5Q). The restraining pin 78 extends through a slot 78B in the middle member 28B of the first cartridge 18 (see FIGS. 5N-5O). The slot 78B in the middle member 28B of the first cartridge 18 allows the first cartridge 18 to rotate about the fastener 78 a predetermined distance. The slot 78B defines the endpoints or limits of the movement of the first cartridge 18 relative to the base 12. As shown, the slot 78B is located on both sides of the middle member 28B.

The restraining pin 78 further extends through a slot 78C in the middle member 30B of the second cartridge 20. The slot 78C in the middle member 30B of the second cartridge 20 allows the first cartridge 20 to rotate about the fastener 78 a predetermined distance. The slot 78C defines the endpoints or limits of the movement of the second cartridge 20 relative to the base 12.

With referent to FIGS. 5B, 5C, 5J, 5K, 5N, and 5O, the backpack 10 may include a support structure 86. The support structure 86 is configured to allow the backpack 10 to be free-standing (see FIG. 4C). The support structure 86 may include a pair of legs 86A rotatably coupled to backpack 10. In the illustrated embodiment, legs 86A are coupled to opposite sides of the top member 28A of the frame 28 of the first cartridge 18 via hinge connections 86B. A pair of clips 86B located on opposite sides of the middle member 28B of the frame 28 of the first cartridge 18 removably retain the legs 86A when not in use.

With specific reference to FIGS. 4C, 5E, 5F, 5J, and 5K, the inner lanes 28E, 30E are defined by an inner divider 28F, 30F which may be integrally formed with the top member 28A, 30A of the frame 28, 30 of the first and second cartridges 18, 20, respectively. An elastic tie 48 (FIG. 4C) may be used to selectively restrict motion of the sporting equipment 24 when located or positioned within the inner lanes 28E, 28F.

In another aspect of the present invention, the outer cover 34 of the second cartridge 20 may include one or more pockets 88 for storing accessories or clothing. The pockets 88 may be closed using zippers or hook and loop fasteners or the like and/or straps. A handle 90 may also be provided on an outer surface of the outer cover 34 of the second cartridge 20.

Third Embodiment

With reference to FIGS. 6A-6G, in which like parts are numbered the same as in the first embodiment, a backpack 10 configured to carry sporting equipment, such as a golf clubs, according to a third embodiment is shown. In the third embodiment, the hinge mechanism 16 includes an unfolding and latching mechanism 100. As will be discussed in more detail below, the unfolding and latching mechanism 100 controllably allows the first and second cartridge 18, 20 to move or rotate between the upright positions (shown in FIGS. 6A) and the cross positions. The unfolding and latching mechanism 100 is moveable between a latched and an unlatched position. In one embodiment, the latched position of the unfolding and latching mechanism 100 corresponds to the upright positions of the first and second cartridges 18, 20. The unfolding and latching mechanism

100 locks or fixes the first and second cartridges 18, 20 in the upright positions until released (see below).

In the illustrated embodiment, the unfolding and latching mechanism 100 includes a symmetrical linkage 102 and a spring mechanism 104. The symmetrical linkage 102 is coupled to and between the base 12 and the first and second cartridges 18, 20. The spring mechanism 104 is coupled between the base 12 and the symmetrical linkage 102. The spring mechanism 104 is configured to be biased to move the symmetrical linkage 102 and the first and second cartridges 18, 20 towards the cross position (when unlatched). As discussed in further detail below, once the unfolding and latch mechanism 100 is released, the first and second cartridges 18, 20 are biased towards the cross-positions but are generally free to move (subject to the force exerted by the spring mechanism 104).

In one aspect of the present invention, the unfolding and latching mechanism 100 rotates the first cartridge 18 in a first direction (indicated by arrow 106A in FIG. 6B) and the second cartridge 20 in a second direction (indicated by arrow 106B). The first and second directions are opposite.

Figure 6A:
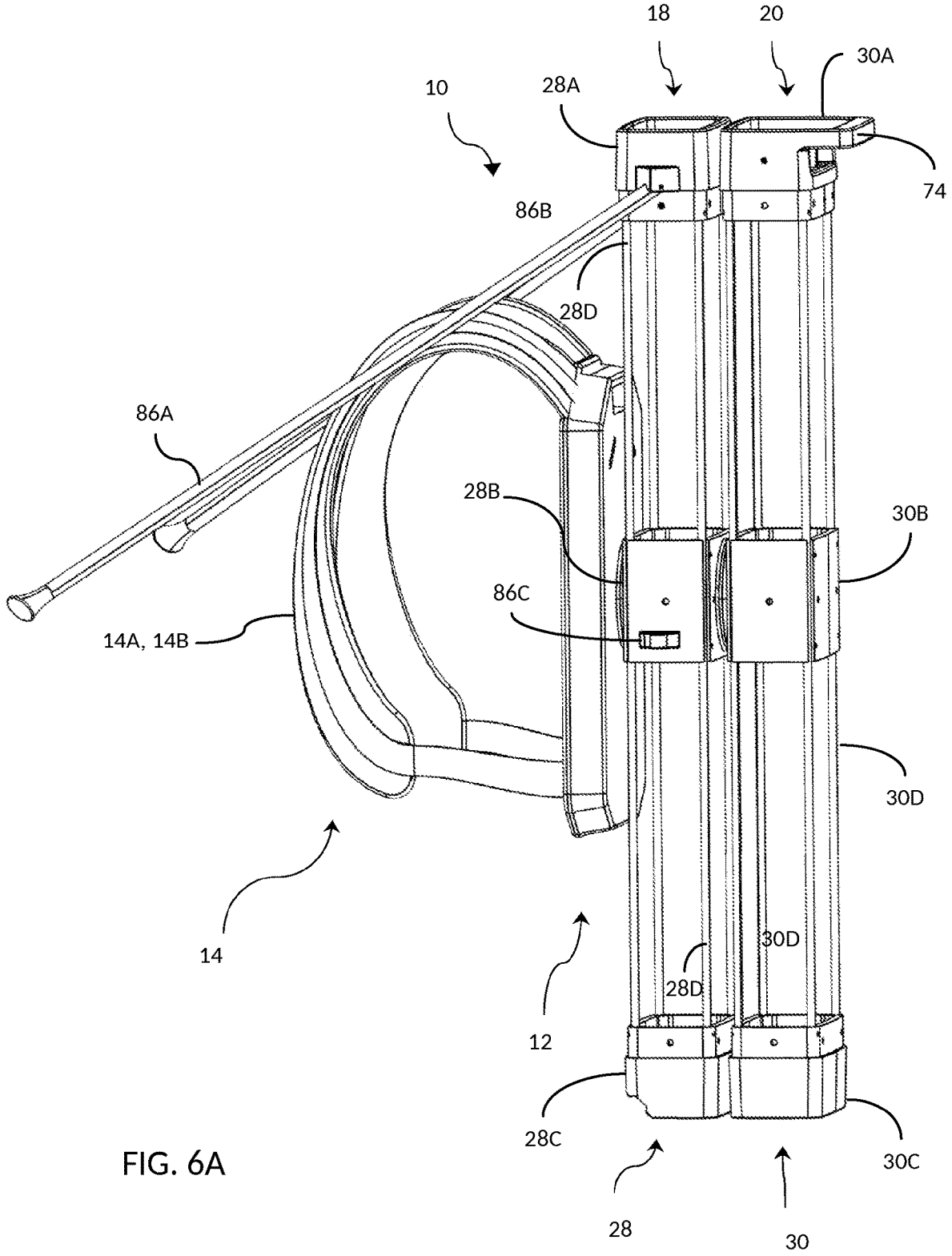
FIG. 6A is a side view of a backpack without the outer covering, according to a third embodiment of the present invention.
Figure 6B:
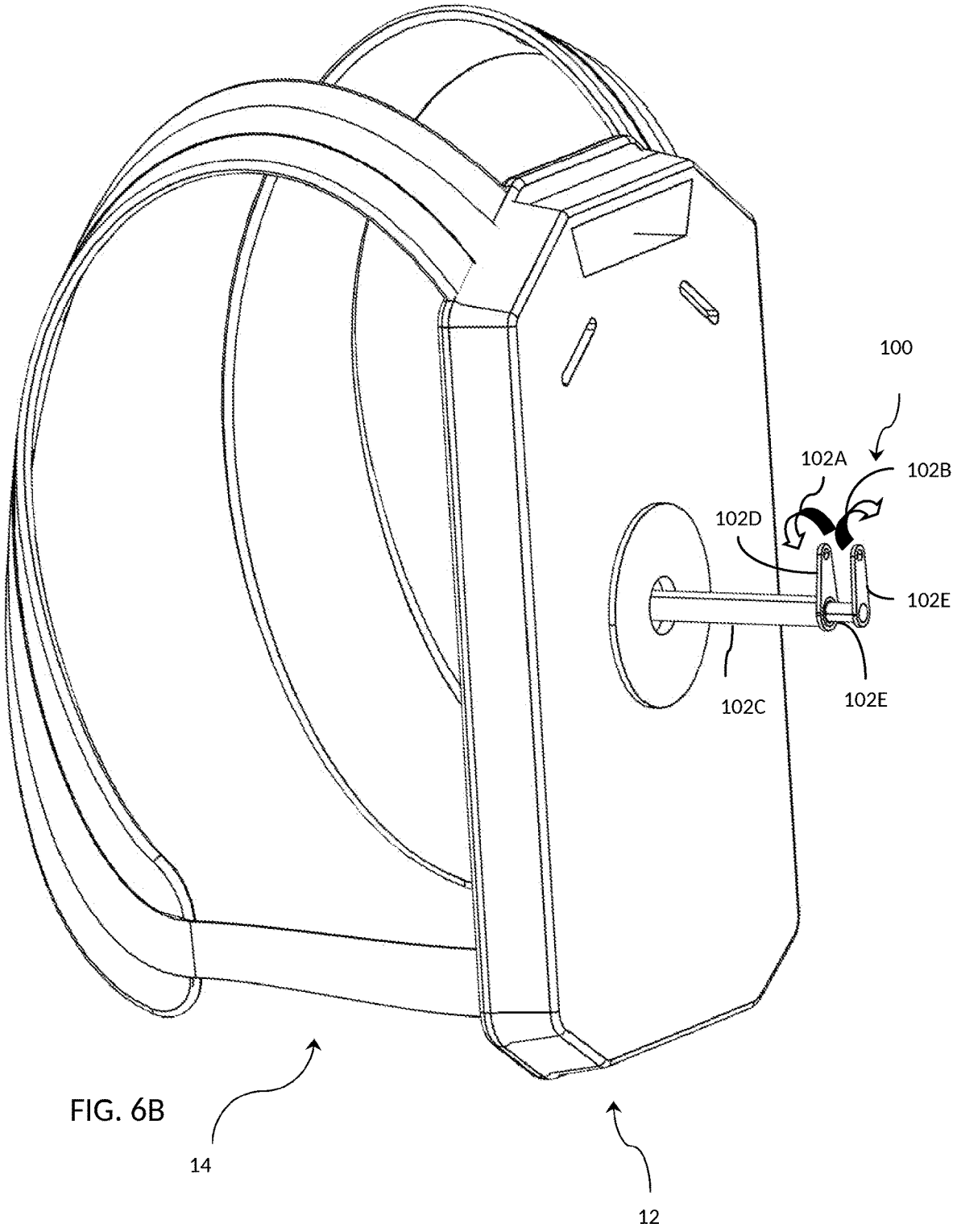
FIG. 6B is a perspective view of a portion of the backpack of FIG. 6A.
Figure 6C:
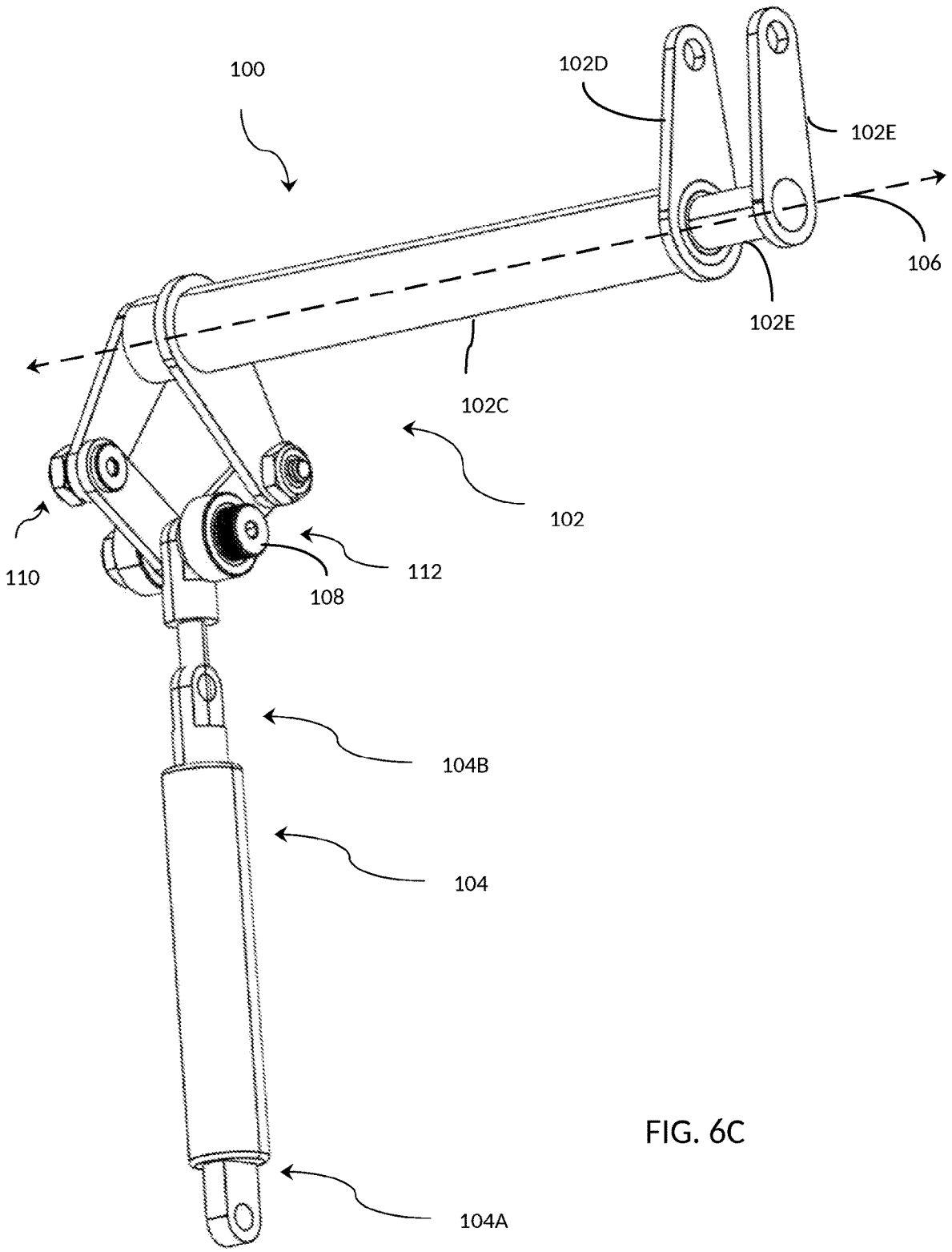
FIG. 6C is a perspective view of a portion of a hinge mechanism of the backpack of FIG. 6A.
Figure 6D:
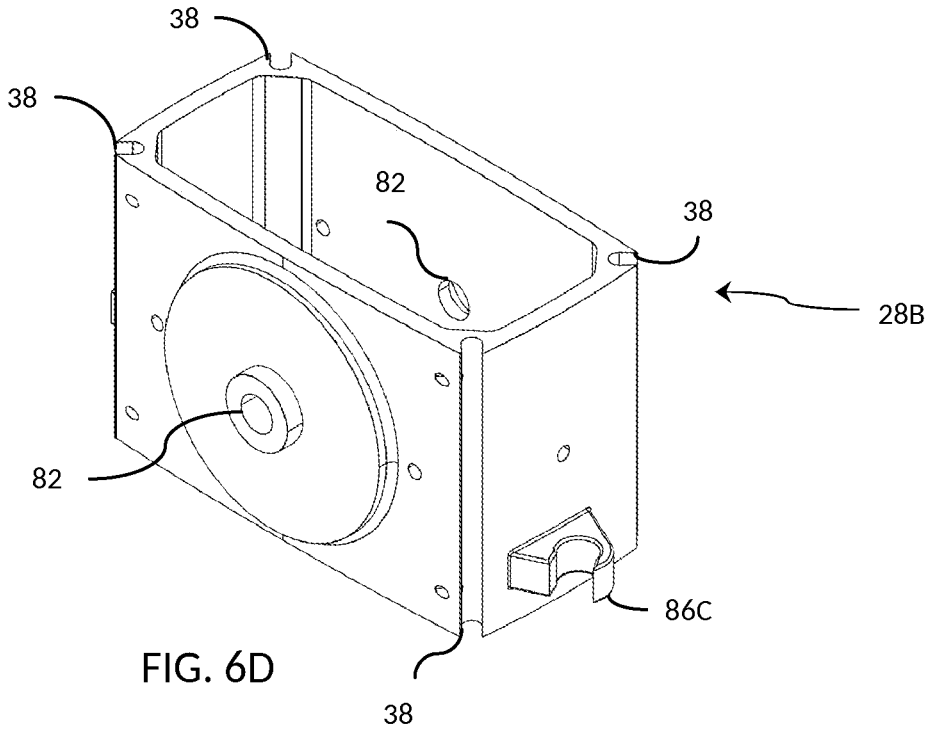
FIG. 6D is a first perspective view of a middle member of a frame of the first cartridge of the backpack of FIG. 6A.

With particular reference to FIGS. 6B and 6C, the symmetrical linkage includes a first axle 102C and a second axle 102E. As shown, the first and second axles 102C, 102E are centered on an axis 106 with the second axles 102E being nested within the first axle 102C. A lever linkage 102D, 102F is fastened or connected to an end of the first and second axles 102C, 102E, respectively.

Figure 6E:
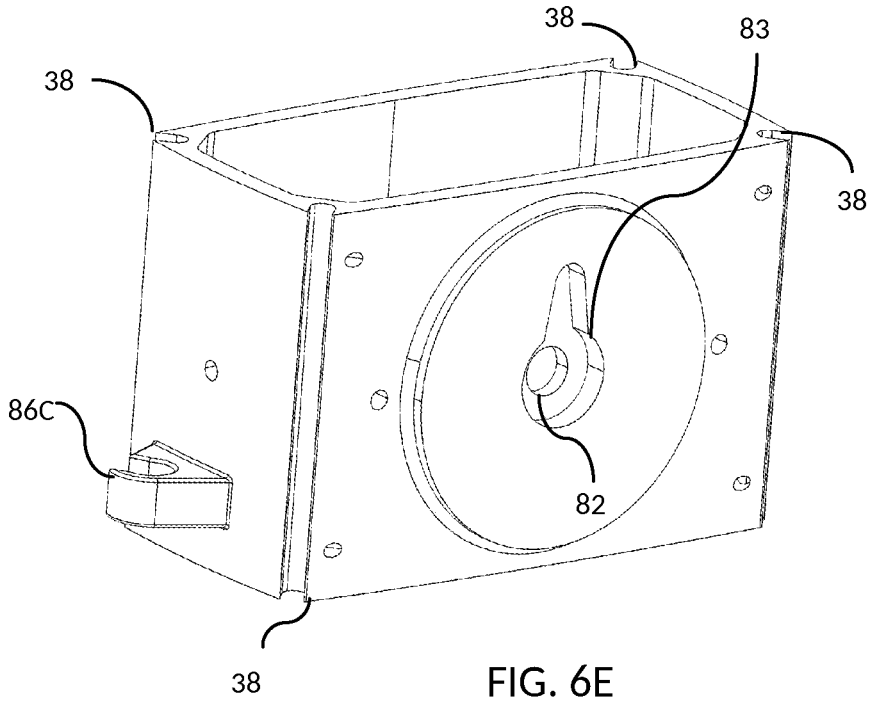
FIG. 6E is a second perspective view of the middle member of the frame of the first cartridge of the backpack of FIG. 6A.
Figure 6F:
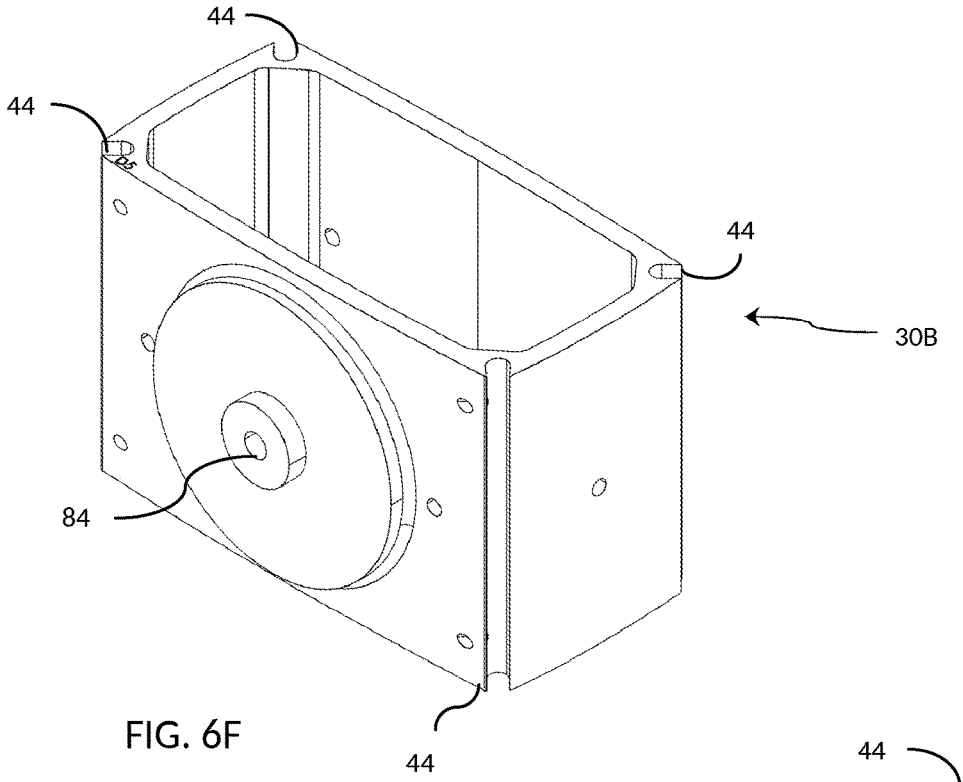
FIG. 6F is a first perspective view of a middle member of a frame of the second cartridge of the backpack of FIG. 6A.
Figure 6G:
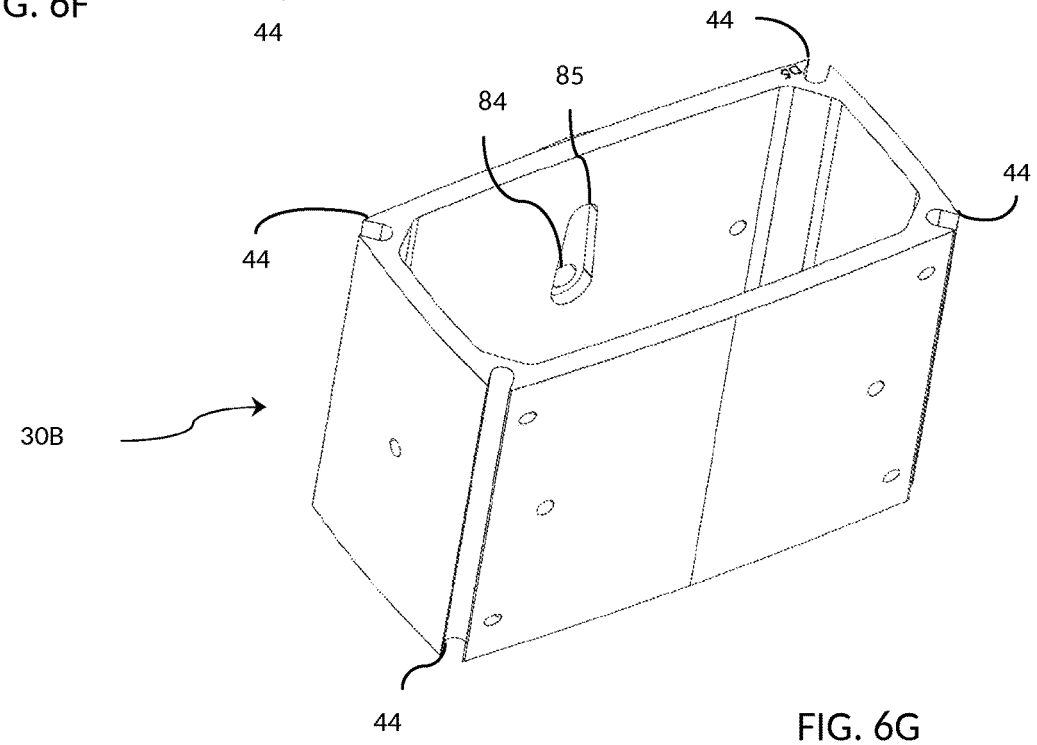
FIG. 6G is a second perspective view of the middle member of the frame of the second cartridge of the backpack of FIG. 6A.

With reference to FIGS. 6D-6G, the first and second lever linkages 102D, 102F pass through apertures 82 in the middle member 28B of the frame 28 of the first cartridge 18. A first key aperture 83 is located on an outer surface of the middle member 28B (FIG. 6E). The first lever linkage 102D is positioned within the first key aperture 83 and coupled thereto via a friction fit, fastener, and/or adhesive. The second axle 102E passes through an aperture 84 within one side of the middle member 30B of the frame 30 of the second cartridge 20. A second key aperture 85 is located on an inner surface of the middle member 30B (FIG. 6G). The second lever linkage 102F is positioned within the second key aperture 85 and coupled thereto via a friction fit, fastener, and/or adhesive.

In the latched position the first and second cartridges 18, 20 are vertical. In this position the spring mechanism 104 is compressed with stored energy. Once unlatched, the spring mechanism 104 extends, which causes the symmetrical linkage 102 to move. The motion of the extension is damped to a controlled velocity. The movement of the symmetrical linkage 104 rotates the first and second axles 102C, 102E in opposite directions resulting in rotation of the first and second cartridges 18, 20. As the spring mechanism 104 extends and the axles 102C, 102E turns, the first and second cartridges 18, 20 are deployed to the riding or cross positions and the spring mechanism 104 is in a fully extended state.

With reference to FIG. 6C, the spring mechanism 104 has a first end 104A and a second end 104B. The first end 104A is coupled to the base 12. A bearing 108 connected to the second end 104B of the spring mechanism 104 allows the second end 104B to move relative to the base 12. The symmetrical linkage 102 further includes a pair of rotational linkages 110, 112 coupled to the second end 104B of the spring mechanism. Each of the rotational linkages 110, 112 are connected to one of the first and second axles 102C, 102E. As the spring mechanism 104 expands and retracts, the rotational linkages 110, 112 impart rotational movement to the respective axle 102C, 102E.

In one aspect of the present invention, the spring mechanism 104 maintains some load on the first and second cartridges 18, 20 maintaining the first and second cartridges 18, 20 in the cross position. In motion or use, if the rider encounters a large bump, the spring mechanism 104 will act as a damper and allow the first and second cartridges 18, 20 to rotate slightly, helping to absorb any shock loading and minimize transfer of shock-load to the rider.

In one embodiment, the spring mechanism 104 may be a gas spring. However, it should be noted that other types of mechanisms may be used, including, but not limited to clock springs, extension springs, compression springs, rotary dampers, etc. . . .

In some embodiments, the unfolding and latching mechanism 100 is a push-push latch. In other words, when the user pushes the first and second cartridges 18, 20 towards the upright positions, the unfolding and latching mechanism 100 latches. To unlatch, the user may simply push again, slightly over center, and then the first and second cartridges will deploy. The latch may be built within the gas spring. However, it should be noted that other types of push-push latches could be utilized.

Fourth Embodiment

Figure 7A:
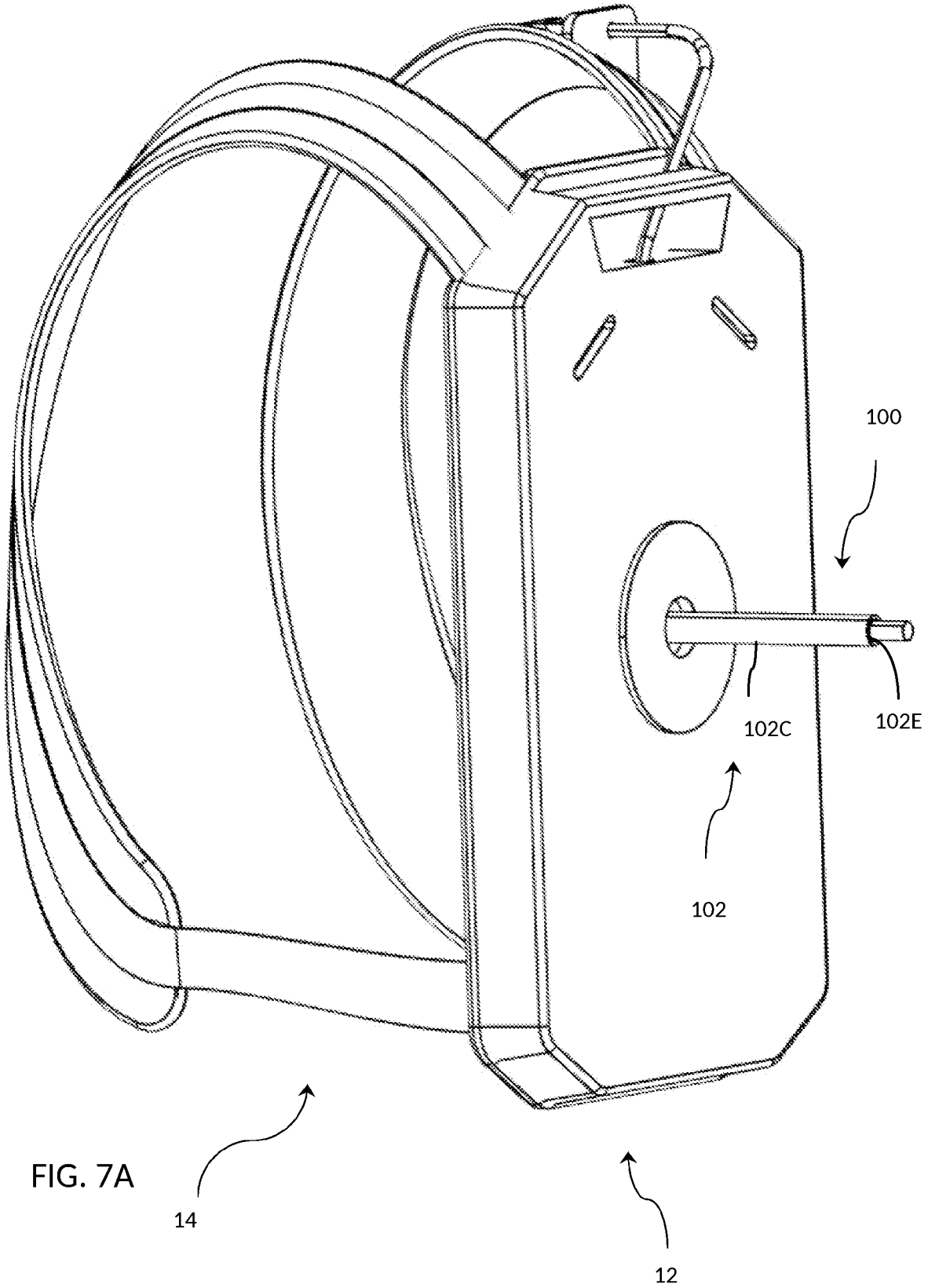
FIG. 7A is a perspective partial view of a backpack according to a fourth embodiment of the present invention.
Figure 7B:
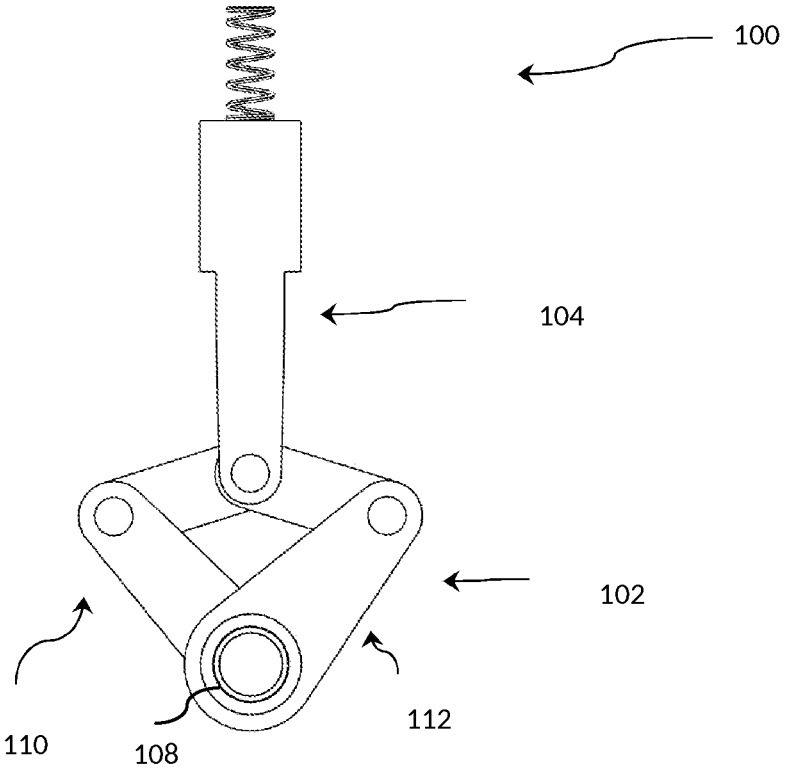
FIG. 7B is a front view of a symmetrical linkage of the backpack of the fourth embodiment of FIG. 7A in a stowed configuration.
Figure 7C:
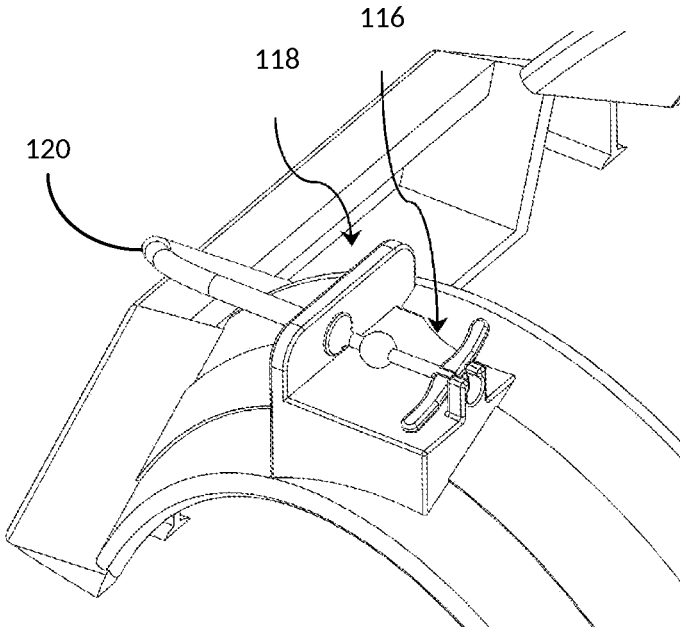
FIG. 7C perspective partial view of the backpack of FIG. 7A in the stowed configuration.
Figure 7D:
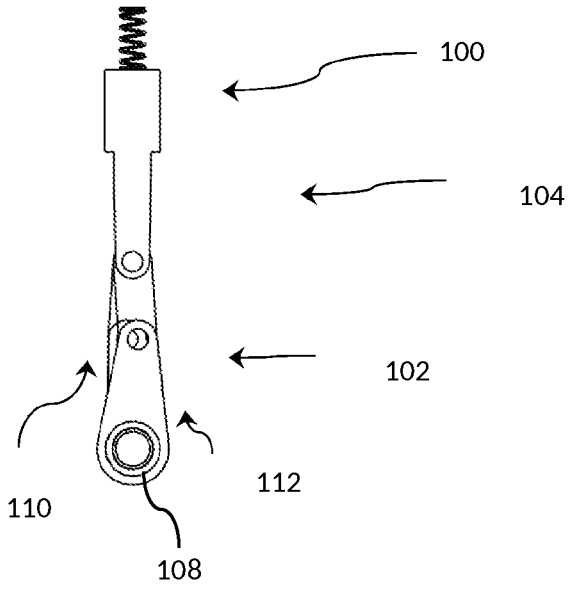
FIG. 7D is a front view of a symmetrical linkage of the backpack of the fourth embodiment of FIG. 7A in a stowed configuration.

With reference to FIGS. 7A-7C, in which like parts are numbered the same as in the first embodiment, a backpack 10 configured to carry sporting equipment, such as a golf clubs, according to a fourth embodiment is shown. The backpack 10 of the fourth embodiment includes an unfolding and latching mechanism 100 similar to the unfolding and latching mechanism 100 of the third embodiment. The unfolding and latching mechanism 100 includes a symmetrical linkage 102 with first and second axles 102C, 102E with first and second lever linkages 102D, 102F that operate in a similar manner (see FIGS. 7B-7E) (although arranged or positioned 180 degrees) and a spring mechanism 104.

As shown, the unfolding and latching mechanism 100 of the fourth embodiment includes a rip-cord style deployment mechanism 114. With reference to FIGS. 7B-7C, the unfolding and latching mechanism 100 is shown in a stowed state, which corresponds to the vertical positions of the first and second cartridges 18, 20. The spring mechanism 104 is configured to bias the symmetrical linkage 102 towards the stowed state. A deployment mechanism 114 includes a pull handle 116, a detent mechanism 118, and a control cable 120. The pull handle 116 and the detent mechanism 118 may be affixed to the shoulder strap of the harness 14. The pull handle 116 has two positions: an extended position (see FIG. 7E) and a retracted position (see FIG. 7C). The pull handle 116 is connected to one end of the cable 120.

The control cable 120 operates a slider 122, which in turn is affixed to the symmetrical linkage 102. As discussed above, the symmetrical linkage 102 drives the first and second axles 102C, 102E in opposite rotational directions. To move the first and second cartridges 18, 20 from the upright positions to the cross positions, the pull handle 116 is pulled from the stowed position to the extended position resulting in movement of the symmetrical linkage 102 thereby causing the first and second axles 102C, 102E and the first and second cartridges 18, 20 to rotate towards the cross position.

A damper may be utilized in parallel with the spring mechanism 104 to control the motion velocity. In the retracted position, the pull handle 116 is closest to the rider's back, the control cable 120 is relaxed, the spring mechanism 104 is extended, and the cartridges 18, 20 are in the deployed or cross positions for riding. The spring mechanism 104 maintains some load on the cartridges 18, 20, keeping them in the cross position. If the rider encounters a large bump, the spring mechanism may allow the cartridges 18, 20 to rotate slightly, helping to absorb any shock loading and minimize transfer of shock-load to the rider.

Figure 7E:
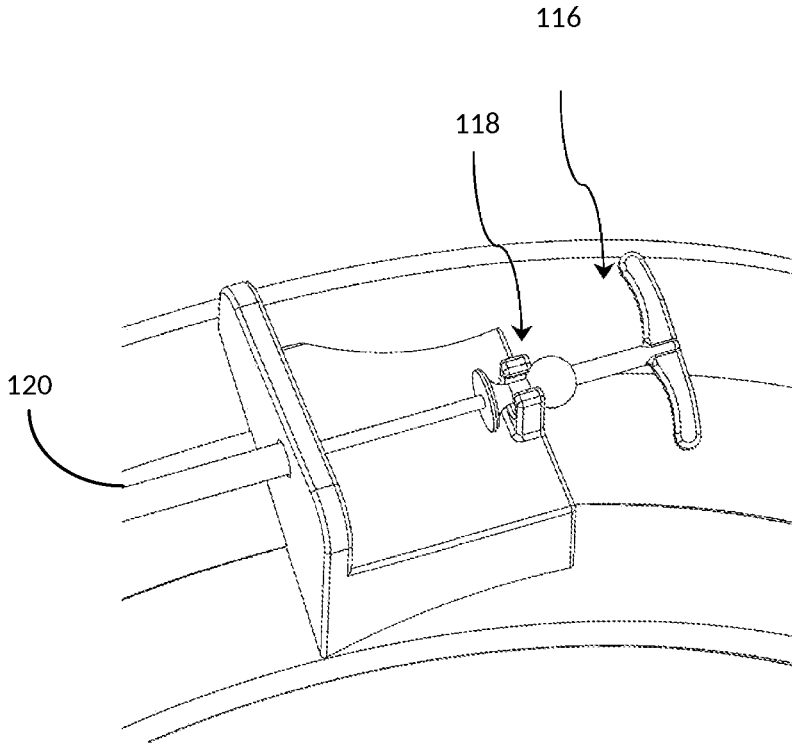
FIG. 7E perspective partial view of the backpack of FIG. 7A in the stowed configuration.

To move the cartridges 18, 20 into the vertical position, the rider grasps the pull handle and pulls towards their chest, extending the cable and nesting the handle into its outer detent (see FIG. 7E). This motion compresses the spring mechanism 104, and the result is that the cartridges are latched into their vertical positions for playing golf.

In one aspect. The spring mechanism 104 of the fourth embodiment includes a compression spring. However, there are numerous types of spring/damper arrangements that could be utilized (such as a clock spring, extension spring, rotary, gas spring, damper, etc).

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A backpack for carrying sporting equipment, comprising:

a base;

a harness coupled to the base and configured to be removably worn by a person;

a hinge mechanism coupled to the base;

a first cartridge configured to removably store at least piece of sporting equipment and being rotatably coupled to the base by the hinge mechanism; and a second cartridge configured to removably store at least one other piece of sporting equipment and rotatably coupled to the base by the hinge mechanism, the hinge mechanism being configured to allow each of the first and second cartridge to be rotated between an upright position and a cross position wherein the hinge mechanism includes an unfolding and latching mechanism for controllably allowing the first and second cartridges to move or rotate between the upright positions and the cross positions, wherein the unfolding and latching mechanism includes a spring mechanism coupled to the base and a symmetrical linkage coupled between the spring mechanism and the first and second cartridges, the spring mechanism configured to bias the first and second cartridges towards one of the upright and cross positions, the symmetrical linkage configured to rotate the first and second cartridges in opposite directions in response to movement of the spring mechanism.

2. The backpack, as set forth in claim 1, wherein each of the first and second cartridge includes a frame and an outer covering.

3. The backpack, as set forth in claim 2, wherein the frame includes at least one framing member, an upper member, and a bottom member, wherein the framing member is coupled between the upper and bottom members.

4. The backpack, as set forth in claim 3, wherein the upper member defines a plurality of predefined inner lanes configured to receive a respective piece of sporting equipment.

5. The backpack, as set forth in claim 1, wherein the harness includes a pair of shoulder straps.

6. The backpack, as set forth in claim 1, including a pair of mounting clips connected to the base.

7. A backpack, comprising:

a base;

a harness including a pair of shoulder straps coupled to the base and configured to be removably worn by a person;

a hinge mechanism coupled to the base;

a first cartridge configured to removably store at least one piece of sporting equipment and being rotatably coupled to the base by the hinge mechanism; and a second cartridge configured to removably store at least one other piece of sporting equipment, the hinge mechanism being configured to allow each of the first and second cartridge to be rotated between an upright position and a cross position, wherein each of the first and second cartridge including a frame and an outer covering, the frame of each of the first and second cartridges including at least one framing member, an upper member and a bottom member, wherein the framing member is coupled between the upper and bottom members, wherein the upper member defines a plurality of predefined inner lanes configured to receive a respective piece of sporting equipment, wherein the hinge mechanism includes an unfolding and latching mechanism for controllably allowing the first and second cartridges to move or rotate between the upright positions and the cross positions, wherein the unfolding and latching mechanism includes a spring mechanism coupled to the base and a symmetrical linkage coupled between the spring mechanism and the first and second cartridges, the spring mechanism configured to bias the first and second cartridges towards one of the upright and cross positions, the symmetrical linkage configured to rotate the first and second cartridges in opposite directions in response to movement of the spring mechanism.

8. The backpack, as set forth in claim 7, wherein each of the first and second cartridge includes a frame and an outer covering.

9. The backpack, as set forth in claim 8, wherein the frame includes at least one framing member, an upper member, and a bottom member, wherein the framing member is coupled between the upper and bottom members.

10. The backpack, as set forth in claim 9, wherein the upper member defines a plurality of predefined inner lanes configured to receive a respective piece of sporting equipment.

11. The backpack, as set forth in claim 7, wherein the harness includes a pair of shoulder straps.

12. The backpack, as set forth in claim 7, including a pair of mounting clips connected to the base.

* * * * *